US010927502B2

(12) United States Patent
Beck

(10) Patent No.: US 10,927,502 B2
(45) Date of Patent: Feb. 23, 2021

(54) MOLDING ROLL FOR MAKING PAPER PRODUCTS

(71) Applicant: GPCP IP Holdings LLC, Atlanta, GA (US)

(72) Inventor: David A. Beck, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 51 days.

(21) Appl. No.: 16/069,917

(22) PCT Filed: Jan. 31, 2017

(86) PCT No.: PCT/US2017/015715
§ 371 (c)(1),
(2) Date: Jul. 13, 2018

(87) PCT Pub. No.: WO2017/139125
PCT Pub. Date: Aug. 17, 2017

(65) Prior Publication Data

US 2019/0032279 A1 Jan. 31, 2019

Related U.S. Application Data

(60) Provisional application No. 62/292,379, filed on Feb. 8, 2016.

(51) Int. Cl.
*D21F 9/04* (2006.01)
*D21F 9/00* (2006.01)
(Continued)

(52) U.S. Cl.
CPC ..... *D21F 9/04* (2013.01); *D21F 7/00* (2013.01); *D21F 9/003* (2013.01); *D21F 11/006* (2013.01);
(Continued)

(58) Field of Classification Search
CPC ..... D21F 11/0006; D21F 11/14; D21F 9/003; D21F 2/00; D21F 5/18; D21F 5/181;
(Continued)

(56) References Cited

U.S. PATENT DOCUMENTS 3,104,197 A 9/1963 Back et al.
4,076,582 A 2/1978 Burkhart et al.
(Continued)

FOREIGN PATENT DOCUMENTS

CA 3012840 A1 * 8/2017 ..... D21F 11/006
CL 199501793 7/1996
(Continued)

OTHER PUBLICATIONS

Ramasubramanian, Melur K., et al., "Modeling and Simulation of the Creping Process", 2011, pp. 1203-1209, Raleigh, North Carolina.
(Continued)

*Primary Examiner* — Jose A Fortuna
(74) *Attorney, Agent, or Firm* — Laura L. Bozek

(57) ABSTRACT

A roll for molding a fibrous sheet. The roll includes a cylindrical shell and a vacuum box. The cylindrical shell is configured to be rotatably driven and is permeable to allow air to be moved through the cylindrical shell. The cylindrical shell has a permeable patterned surface on an exterior surface of the cylindrical shell. The permeable patterned surface has at least one of a plurality of recesses and a plurality of projections. The density of the at least one of the plurality of recesses and the plurality of projections is greater than about fifty per square inch. The vacuum box is positioned on the inside of the cylindrical shell and is configured to draw air from the exterior surface of the
(Continued)

cylindrical shell to an interior surface of the cylindrical shell. The vacuum box is stationary with respect to the rotation of the cylindrical shell.

33 Claims, 24 Drawing Sheets

(51) Int. Cl.

| | |
|---|---|
| ***D21F 11/14*** | (2006.01) |
| ***D21F 7/00*** | (2006.01) |
| ***D21H 27/00*** | (2006.01) |
| ***D21F 11/00*** | (2006.01) |
| ***D21F 11/06*** | (2006.01) |
| ***D21H 27/02*** | (2006.01) |

(52) U.S. Cl.
CPC ..... *D21F 11/06* (2013.01); *D21F 11/14* (2013.01); *D21F 11/145* (2013.01); *D21H 27/002* (2013.01); *D21H 27/02* (2013.01)

(58) Field of Classification Search
CPC . D21F 11/06; D21F 7/00; D21F 7/003; D21F 7/12; D21F 11/145; D21H 27/02; D21H 27/002; D21G 3/005; B31F 1/126; B31F 1/16; B31F 1/12
See application file for complete search history.

(56) References Cited

U.S. PATENT DOCUMENTS 4,551,199 A 11/1985 Weldon
4,608,108 A 8/1986 Goll
4,698,257 A 10/1987 Goll
4,888,096 A 12/1989 Cowan et al.
5,314,584 A 5/1994 Grinnell et al.
5,411,636 A 5/1995 Hermans et al.
5,492,598 A 2/1996 Hermans et al.
5,505,818 A 4/1996 Hermans et al.
5,510,001 A 4/1996 Hermans et al.
5,510,002 A 4/1996 Hermans et al.
5,704,101 A 1/1998 Majors et al.
6,083,346 A 7/2000 Hermans et al.
6,113,470 A 9/2000 Marinack et al.
6,161,303 A 12/2000 Beck et al.
6,187,139 B1 2/2001 Edwards et al.
6,203,666 B1 3/2001 Hanaya
6,209,224 B1 4/2001 Chuang et al.
6,231,723 B1 5/2001 Kanitz et al.
6,248,210 B1 6/2001 Edwards et al.
6,287,426 B1 9/2001 Edwards et al.
6,302,671 B1 10/2001 Gilfert et al.
6,344,110 B1 * 2/2002 Reiner ..... D21F 11/006 162/109
6,379,496 B2 4/2002 Edwards et al.
6,387,217 B1 5/2002 Edwards et al.
6,395,136 B1 5/2002 Andersson et al.
6,395,163 B1 5/2002 Schneider et al.
6,398,909 B1 * 6/2002 Klerelid ..... D21F 3/0281 162/109
6,416,631 B1 7/2002 Beck et al.
6,447,640 B1 9/2002 Watson et al.
6,458,246 B1 10/2002 Kanitz et al.
6,458,248 B1 10/2002 Edwards et al.
6,514,382 B1 2/2003 Kakiuchi et al.
6,517,672 B2 2/2003 Edwards et al.
6,554,601 B2 * 4/2003 Ampulski ..... D21F 11/006 425/503
6,592,721 B1 7/2003 Anderson et al.
6,669,821 B2 12/2003 Edwards et al.
6,673,204 B2 1/2004 Takai et al.
6,716,017 B2 * 4/2004 Papadopoulas ..... B31F 1/07 156/582
6,746,573 B2 6/2004 Stelljes, Jr. et al.
6,855,227 B2 * 2/2005 Beck ..... D21F 3/0254 162/109
6,878,238 B2 4/2005 Bakken et al.
6,998,017 B2 2/2006 Lindsay et al.
7,070,678 B2 * 7/2006 Allen ..... D21F 3/105 162/109
7,141,142 B2 11/2006 Strohbeen et al.
7,182,837 B2 2/2007 Chen et al.
7,294,238 B2 11/2007 Bakken et al.
7,300,552 B2 11/2007 Edwards et al.
7,399,378 B2 7/2008 Edwards et al.
7,442,278 B2 10/2008 Murray et al.
7,462,257 B2 12/2008 Beuther et al.
7,493,923 B2 2/2009 Barrett et al.
7,494,563 B2 2/2009 Edwards et al.
7,563,344 B2 7/2009 Beuther et al.
7,624,765 B2 * 12/2009 Burazin ..... D21F 11/006 139/383 A
7,625,461 B2 12/2009 Burazin et al.
7,662,257 B2 2/2010 Edwards et al.
7,754,049 B2 7/2010 Edwards et al.
7,758,727 B2 7/2010 Beuther et al.
7,789,995 B2 9/2010 Super et al.
8,012,309 B2 9/2011 Pare et al.
8,080,130 B2 12/2011 Harper et al.
8,142,613 B2 3/2012 Biagiotti
8,142,614 B2 3/2012 Biagiotti
8,152,958 B2 * 4/2012 Super ..... D21H 27/005 162/111
8,211,273 B2 7/2012 Andersson
8,293,072 B2 10/2012 Super et al.
8,388,329 B2 3/2013 Alkmin et al.
8,398,818 B2 3/2013 Edwards et al.
8,425,730 B2 4/2013 Biagiotti
8,597,469 B2 12/2013 Biagiotti
9,279,219 B2 3/2016 Edwards et al.
9,340,914 B2 5/2016 Manifold et al.
9,388,534 B2 7/2016 Super et al.
10,697,120 B2 6/2020 Ruthven et al.
2001/0013389 A1 * 8/2001 Fingal ..... D21F 3/0281 156/160
2002/0060008 A1 * 5/2002 Hollmark ..... D21F 3/0281 162/132
2002/0088594 A1 7/2002 Edwards et al.
2002/0088595 A1 7/2002 Edwards et al.
2002/0100153 A1 8/2002 Takai et al.
2002/0197346 A1 * 12/2002 Papadopoulos ..... B31F 1/07 425/194
2004/0118546 A1 6/2004 Bakken et al.
2004/0149405 A1 * 8/2004 Beck ..... D21F 3/0254 162/115
2004/0200590 A1 * 10/2004 Wilhelm ..... B31F 1/07 162/118
2005/0126728 A1 6/2005 Beuther et al.
2005/0241787 A1 11/2005 Murray et al.
2006/0070714 A1 4/2006 Perini
2006/0137840 A1 * 6/2006 Burazin ..... D21F 11/006 162/109
2006/0243408 A1 11/2006 Blodgett et al.
2007/0068645 A1 * 3/2007 Silva ..... D21F 3/0272 162/289
2007/0137814 A1 * 6/2007 Gao ..... D21F 11/006 162/117
2007/0151692 A1 7/2007 Beuther et al.
2007/0209770 A1 9/2007 Barrett et al.
2008/0035289 A1 2/2008 Edwards et al.
2008/0308240 A1 12/2008 Biagiotti
2009/0199986 A1 8/2009 Biagiotti
2010/0186913 A1 7/2010 Super et al.
2011/0303380 A1 12/2011 Andersson et al.
2012/0152477 A1 6/2012 Biagiotti
2012/0199300 A1 8/2012 Edwards et al.
2012/0205063 A1 8/2012 Biagiotti
2013/0143001 A1 6/2013 Manifold et al.
2015/0068695 A1 3/2015 Edwards et al.
2015/0152603 A1 6/2015 Super et al.
2018/0051420 A1 * 2/2018 Ostendorf ..... D21H 27/005
2019/0017224 A1 * 1/2019 Beck ..... D21F 9/003

(56) References Cited

U.S. PATENT DOCUMENTS

| | | | | |
|---|---|---|---|---|
| 2019/0032279 | A1* | 1/2019 | Beck | D21F 9/003 |
| 2019/0048525 | A1* | 2/2019 | Ruthven | D21F 11/06 |
| 2019/0062997 | A1* | 2/2019 | Beck | D21F 7/003 |
| 2020/0240082 | A1 | 7/2020 | Ruthven | |

FOREIGN PATENT DOCUMENTS

| | | | | |
|---|---|---|---|---|
| CL | 2018002066 | A1 | 11/2018 | |
| CL | 2018002067 | A1 | 11/2018 | |
| CN | 1217642 | A | 5/1999 | |
| CN | 101313108 | A | 11/2008 | |
| CN | 101405443 | A | 4/2009 | |
| CN | 101529019 | A | 9/2009 | |
| CN | 104195865 | A | 12/2014 | |
| CN | 103469694 | B | 8/2016 | |
| DE | 10157467 | A1 | 5/2003 | |
| DE | 102004056643 | A1 | 6/2006 | |
| DE | 102005031251 | A1 | 4/2007 | |
| EP | 0 108 381 | A1 | 5/1984 | |
| EP | 0 625 610 | A1 | 11/1994 | |
| EP | 1 541 755 | A1 | 6/2005 | |
| GB | 903508 | | 8/1962 | |
| JP | 52-7306 | | 1/1977 | |
| JP | H10-245790 | A | 9/1998 | |
| JP | 2004-538390 | A | 12/2004 | |
| RU | 2370586 | C2 | 10/2009 | |
| SU | 38860 | A1 | 9/1934 | |
| WO | 0233168 | A1 | 4/2002 | |
| WO | 2005/106116 | A1 | 11/2005 | |
| WO | 2007046124 | A1 | 4/2007 | |
| WO | 2015/095431 | A1 | 6/2015 | |
| WO | 20170139125 | A1 | 8/2017 | |
| WO | WO-2017139123 | A1 * | 8/2017 | B31F 1/126 |
| WO | WO-2017139124 | A1 * | 8/2017 | D21F 11/14 |

OTHER PUBLICATIONS

International Preliminary Report on Patentability ated Aug. 23, 2018, issued in related International Patent Application No. PCT/US2017/015710.

International Preliminary Report on Patentability dated Aug. 23, 2018, issued in related International Patent Application No. PCT/US2017/015713.

International Preliminary Report on Patentability dated Aug. 23, 2018, issued in corresponding International Patent Application No. PCT/US2017/015715.

International Search and Written Opinion dated May 16, 2017 in PCT/US2017/015710.

International Search and Written Opinion dated May 16, 2017 in PCT/US2017/015713.

International Search and Written Opinion dated May 11, 2017 in PCT/US2017/015715.

Annex to the European Search Report dated Sep. 30, 2019, issued in corresponding European Patent Application No. EP 17 75 0571.

Annex to the European Search Report dated Sep. 25, 2019, issued in corresponding European Patent Application No. EP 17 75 0572.

Supplementary European Search Report dated Sep. 26, 2019, issued in corresponding on European Patent Application No. EP 17 75 0573.

Office Action dated Jan. 9, 2020, issued in corresponding Chilean Patent Application No. 201802066.

Office Action dated Jan. 13, 2020, issued in corresponding Chilean Patent Application No. 201802067.

Chilean Office Action dated Jul. 12, 2020, issued in corresponding Chilean Patent Application No. 201802067.

Chinese Office Action dated Jul. 13, 2020, issued in corresponding Chinese Application No. 201780010350.8.

Chinese Office Action dated Jul. 16, 2020, issued in corresponding Chinese Application No. 201780010349.5.

Russian Office Action dated May 20, 2020, issued in corresponding Russian Application No. 2018132055.

Russian Office Action dated May 27, 2020, issued in corresponding Russian Application No. 2018132053.

Chilean Office Action dated Mar. 16, 2020, issued in corresponding Chilean Patent Application No. 201802068.

Chinese Office Action dated Jun. 3, 2020, issued in corresponding Chinese Application No. 201780010356.5.

Russian Decision to Grant dated Apr. 29, 2020, issued in corresponding Russian Application No. 2018132054.

Decision to Grant dated Sep. 23, 2020, issued in corresponding Russian Application No. 2015132053.

Japanese Office Action dated Oct. 20, 2020, issued in corresponding Japanese Application No. 2018-541342.

Russian Decision to Grant dated Oct. 8, 2020, issued in corresponding Russian Application No. 2018132055.

Japanese Office Action dated Nov. 17, 2020, issued in corresponding Japanese Application No. 2018-541287.

Japanese Office Action dated Nov. 17, 2020, issued in corresponding Japanese Application No. 2018-541337.

* cited by examiner

MOLDING ROLL FOR MAKING PAPER PRODUCTS

CROSS REFERENCE TO RELATED APPLICATIONS

This application is a U.S. national stage application of International Patent Application No. PCT/US2017/015715, filed Jan. 31, 2017, which claims the benefit of priority of U.S. Provisional Patent Application No. 62/292,379, filed Feb. 8, 2016, each of which is incorporated by reference herein in its entirety.

FIELD OF THE INVENTION

My invention relates to methods and apparatuses for manufacturing paper products such as paper towels and bathroom tissue. In particular, my invention relates to a molding roll to mold a paper web during the formation of the paper product.

BACKGROUND OF THE INVENTION

Generally speaking, paper products are formed by depositing a furnish comprising an aqueous slurry of papermaking fibers onto a forming section to form a paper web, and then dewatering the web to form a paper product. Various methods and machinery are used to form the paper web and to dewater the web. In papermaking processes to make tissue and towel products, for example, there are many ways to remove water in the processes, each with substantial variability. As a result, the paper products likewise have a large variability in properties.

One such method of dewatering a paper web is known in the art as conventional wet pressing (CWP). FIG. 1 shows an example of a CWP papermaking machine 100. Papermaking machine 100 has a forming section 110, which, in this case, is referred to in the art as a crescent former. The forming section 110 includes headbox 112 that deposits an aqueous furnish between a forming fabric 114 and a papermaking felt 116, thereby initially forming a nascent web 102. The forming fabric 114 is supported by rolls 122, 124, 126, 128. The papermaking felt 116 is supported by a forming roll 120. The nascent web 102 is transferred by the papermaking felt 116 along a felt run 118 that extends to a press roll 132 where the nascent web 102 is deposited onto a Yankee dryer section 140 in a press nip 130. The nascent web 102 is wet-pressed in the press nip 130 concurrently with the transfer to the Yankee dryer section 140. As a result, the consistency of the web 102 is increased from about twenty percent solids just prior to the press nip 130 to between about thirty percent solids and about fifty percent solids just after the press nip 130. The Yankee dryer section 140 comprises, for example, a steam filled drum 142 ("Yankee drum") and hot air dryer hoods 144, 146 to further dry the web 102. The web 102 may be removed from the Yankee drum 142 by a doctor blade 152 where it is then wound on a reel (not shown) to form a parent roll 190.

A CWP papermaking machine, such as papermaking machine 100, typically has low drying costs, and can quickly produce the parent roll 190 at speeds from about three thousand feet per minute to in excess of five thousand feet per minute. Papermaking using CWP is a mature process that provides a papermaking machine having high runability and uptime. As a result of the compaction used to dewater the web 102 at the press nip 130, the resulting paper product typically has a low bulk with a corresponding high fiber cost.

While this can result in rolled paper products, such as paper towels or toilet paper, having a high sheet count per roll, the paper products generally have a low absorbency and can feel rough to the touch.

As consumers often desire paper products that feel soft and have a high absorbance, other papermaking machines and methods have been developed. Through-air-drying (TAD) is one method that results in paper products with high bulk. FIG. 2 shows an example of a TAD papermaking machine 200. The forming section 230 of this papermaking machine 200 is shown with what is known in the art as a twin-wire forming section and it produces a sheet similar to the crescent former 110 of FIG. 1. As shown in FIG. 2, the furnish is initially supplied in the papermaking machine 200 through a headbox 202. The furnish is directed by the headbox 202 into a nip formed between a first forming fabric 204 and a second forming fabric 206, ahead of forming roll 208. The first forming fabric 204 and the second forming fabric 206 move in continuous loops and diverge after passing beyond forming roll 208. Vacuum elements such as vacuum boxes, or foil elements (not shown) can be employed in the divergent zone to both dewater the sheet and to insure that the sheet stays adhered to second forming fabric 206. After separating from the first forming fabric 204, the second forming fabric 206 and web 102 pass through an additional dewatering zone 212 in which suction boxes 214 remove moisture from the web 102 and second forming fabric 206, thereby increasing the consistency of the web 102 from, for example, about ten percent solids to about twenty-eight percent solids. Hot air may also be used in dewatering zone 212 to improve dewatering. The web 102 is then transferred to a through-air drying (TAD) fabric 216 at transfer nip 218, where a shoe 220 presses the TAD fabric 216 against the second forming fabric 206. In some TAD papermaking machines, the shoe 220 is a vacuum shoe that applies a vacuum to assist in the transfer of the web 102 to the TAD fabric 216. Additionally, so-called rush transfer maybe used to transfer the web 102 in transfer nip 218 as well as structure it. Rush transfer occurs when the second forming fabric 206 travels at a speed that is faster than the TAD fabric 216.

The TAD fabric 216 carrying the paper web 102 next passes around through-air dryers 222, 224 where hot air is forced through the web to increase the consistency of the paper web 102, from about twenty-eight percent solids to about eighty percent solids. The web 102 is then transferred to the Yankee dryer section 140, where the web 102 is further dried. The sheet is then doctored off the Yankee drum 142 by doctor blade 152 and is taken up by a reel (not shown) to form a parent roll (not shown). As a result of the minimal compaction during the drying process, the resulting paper product has a high bulk with corresponding low fiber cost. Unfortunately, this process is costly to operate because a lot of water is removed by expensive thermal drying. In addition, the papermaking fibers in a paper product made by TAD typically are not strongly bound, resulting in a paper product that can be weak.

Other methods have been developed to increase the bulk and softness of the paper product as compared to CWP, while still retaining strength in the paper web and having low drying costs as compared to TAD. These methods generally involve compactively dewatering the wet web and then belt creping the web so as to redistribute the web fibers in order to achieve desired properties. This method is referred to herein as belt creping and is described in, for example, U.S. Pat. Nos. 7,399,378, 7,442,278, 7,494,563, 7,662,257, and 7,789,995 (the disclosures of which are incorporated by reference in their entirety).

FIG. 3 shows an example of a papermaking machine 300 used for belt creping. Similar to the CWP papermaking machine 100, shown in FIG. 1, the belt creping papermaking machine 300 uses a crescent former, discussed above, as the forming section 110. After leaving the forming section 110, the felt run 118, which is supported on one end by roll 108, extends to a shoe press section 310. Here, the web 102 is transferred from the papermaking felt 116 to a backing roll 312 in a nip formed between the backing roll 312 and a shoe press roll 314. A shoe 316 is used to load the nip and dewater the web 102 concurrently with the transfer.

The web 102 is then transferred onto a creping belt 322 in a belt creping nip 320 by the action of the creping nip 320. The creping nip 320 is defined between the backing roll 312 and the creping belt 322, with the creping belt 322 being pressed against the backing roll 312 by a creping roll 326. In the transfer at the creping nip 320, the cellulosic fibers of the web 102 are repositioned and oriented. The web 102 may tend to stick to the smoother surface of the backing roll 312 relative to the creping belt 322. Consequently, it may be desirable to apply release oils on the backing roll 312 to facilitate the transfer from the backing roll 312 to the creping belt 322. Also, the backing roll 312 may be a steam heated roll. After the web 102 is transferred onto the creping belt 322, a vacuum box 324 may be used to apply a vacuum to the web 102 in order to increase sheet caliper by pulling the web 102 into the creping belt 322 topography.

It generally is desirable to perform a rush transfer of the web 102 from the backing roll 312 to the creping belt 322 in order to facilitate transfer to creping belt 322 and to further improve sheet bulk and softness. During a rush transfer, the creping belt 322 is traveling at a slower speed than the web 102 on the backing roll 312. Among other things, rush transferring redistributes the paper web 102 on the creping belt 322 to impart structure to the paper web 102 to increase bulk and to enhance transfer to the creping belt 322.

After this creping operation, the web 102 is deposited on a Yankee drum 142 in the Yankee dryer section 140 in a low intensity press nip 328. As with the CWP papermaking machine 100 shown in FIG. 1, the web 102 is then dried in the Yankee dryer section 140 and then wound on a reel (not shown). While the creping belt 322 imparts desirable bulk and structure to the web 102, the creping belt 322 may be difficult to use. As the creping belt 322 moves through its travel, the belt bends and flexes, resulting in fatigue of the creping belt 322. Thus, the creping belt 322 is susceptible to fatigue failure. In addition, creping belts 322 are custom designed elements with no other commercial analog. They are designed to impart a targeted structure to the paper web, and can be difficult to manufacture since they are a low volume element and little prior commercial history exists. Further, the speed of the papermaking machine 300 is slowed by the crepe ratio when the web 102 is rush transferred from the backing roll 312 to the creping belt 322. The slower exiting web speed leads to lower production speeds compared to non-belt creped systems. Additionally, such creping belt runs require large amounts of floor space and thus increase the size and complexity of the papermaking machine 300. Furthermore, uniform, reliable sheet transfer to the creping belt 322 may be challenging to achieve. Accordingly, there is thus a desire to develop methods and apparatuses that are able to achieve the paper qualities comparable to fabric creping without the difficulties of the creping belt.

SUMMARY OF THE INVENTION

According to one aspect, my invention relates to a roll for molding a fibrous sheet. The roll includes a cylindrical shell and a vacuum box. The cylindrical shell is configured to be rotatably driven in a circumferential direction and is permeable to allow air to be moved through the cylindrical shell. The cylindrical shell has an interior surface, an exterior surface, and a permeable patterned surface on the exterior surface of the cylindrical shell. The permeable patterned surface has at least one of a plurality of recesses and a plurality of projections. The density of the at least one of the plurality of recesses and the plurality of projections is greater than about fifty per square inch. The vacuum box is positioned on the inside of the cylindrical shell and is configured to draw air from the exterior surface of the cylindrical shell to the interior surface of the cylindrical shell. The vacuum box is stationary with respect to the rotation of the cylindrical shell.

This and other aspects of my invention will become apparent from the following disclosure.

DETAILED DESCRIPTION OF THE PREFERRED EMBODIMENTS

Figure 1:
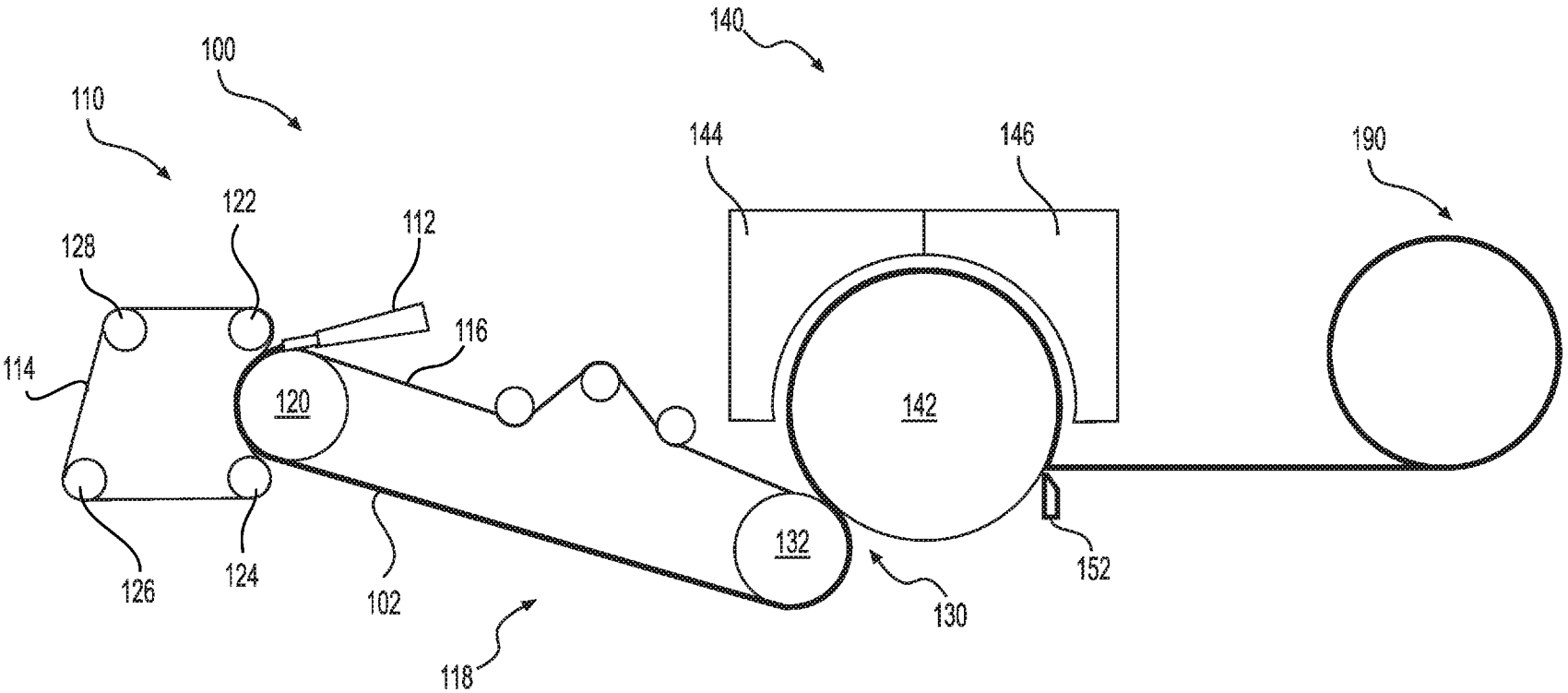
FIG. 1 Prior Art
FIG. 1 is a schematic diagram of a conventional wet press papermaking machine.

My invention relates to papermaking processes and apparatuses that use a molding roll to produce a paper product. I will describe embodiments of my invention in detail below with reference to the accompanying figures. Throughout the specification and accompanying drawings, the same reference numerals will be used to refer to the same or similar components or features.

The term "paper product," as used herein, encompasses any product incorporating papermaking fibers. This would include, for example, products marketed as paper towels, toilet paper, facial tissues, etc. Papermaking fibers include virgin pulps or recycle (secondary) cellulosic fibers, or fiber mixes comprising at least fifty-one percent cellulosic fibers. Such cellulosic fibers may include both wood and non-wood fibers. Wood fibers include, for example, those obtained from deciduous and coniferous trees, including softwood fibers, such as northern and southern softwood kraft fibers, and hardwood fibers, such as eucalyptus, maple, birch, aspen, or the like. Examples of fibers suitable for making the products of my invention include nonwood fibers, such as cotton fibers or cotton derivatives, abaca, kenaf, sabai grass, flax, esparto grass, straw, jute hemp, bagasse, milkweed floss fibers, and pineapple leaf fibers. Additional papermaking fibers could include non-cellulosic substances such as calcium carbonite, titanium dioxide inorganic fillers, and the like, as well as typical manmade fibers like polyester, polypropylene, and the like, which may be added intentionally to the furnish or may be incorporated when using recycled paper in the furnish.

"Furnishes" and like terminology refers to aqueous compositions including papermaking fibers, and, optionally, wet strength resins, debonders, and the like, for making paper products. A variety of furnishes can be used in embodiments of my invention. In some embodiments, furnishes are used according to the specifications described in U.S. Pat. No. 8,080,130 (the disclosure of which is incorporated by reference in its entirety). As used herein, the initial fiber and liquid mixture (or furnish) that is dried to a finished product in a papermaking process will be referred to as a "web," "paper web," a "cellulosic sheet," and/or a "fibrous sheet." The finished product may also be referred to as a cellulosic sheet and or a fibrous sheet. In addition, other modifiers may variously be used to describe the web at a particular point in the papermaking machine or process. For example, the web may also be referred to as a "nascent web," a "moist nascent web," a "molded web," and a "dried web."

When describing my invention herein, the terms "machine direction" (MD) and "cross machine direction" (CD) will be used in accordance with their well understood meaning in the art. That is, the MD of a fabric or other structure refers to the direction that the structure moves on a papermaking machine in a papermaking process, while CD refers to a direction crossing the MD of the structure. Similarly, when referencing paper products, the MD of the paper product refers to the direction on the product that the product moved on the papermaking machine in the papermaking process, and the CD of the product refers to the direction crossing the MD of the product.

When describing my invention herein, specific examples of operating conditions for the paper machine and converting line will be used. For example, various speeds and pressures will be used when describing paper production on the paper machine. Those skilled in the art will recognize that my invention is not limited to the specific examples of operating conditions including speeds and pressures that are disclosed herein.

I. First Embodiment of a Papermaking Machine

Figure 2:
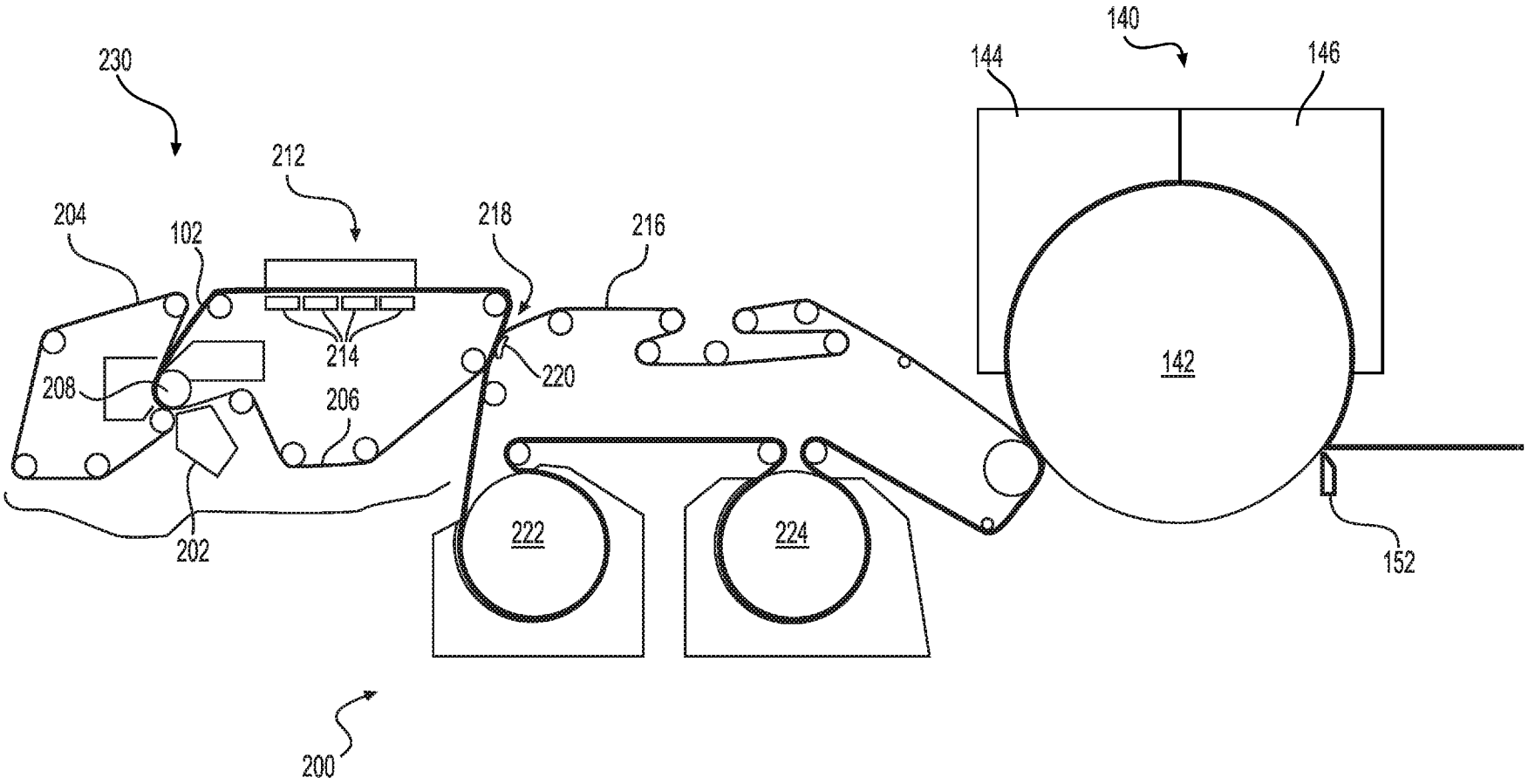
FIG. 2 Prior Art
FIG. 2 is a schematic diagram of a through-air-drying papermaking machine.
Figure 3:
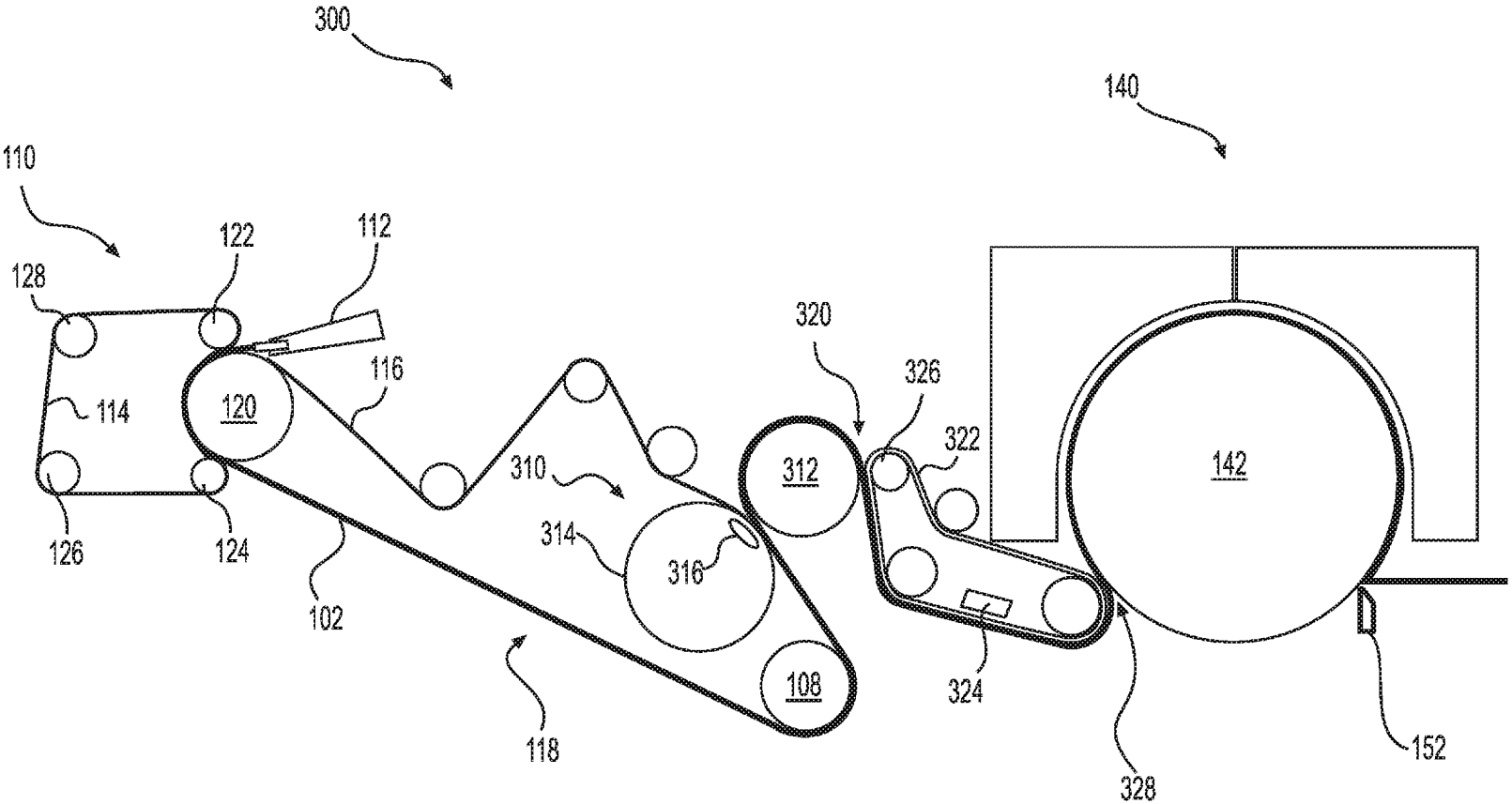
FIG. 3 Prior Art
FIG. 3 is a schematic diagram of a papermaking machine used with belt creping.
Figure 4:
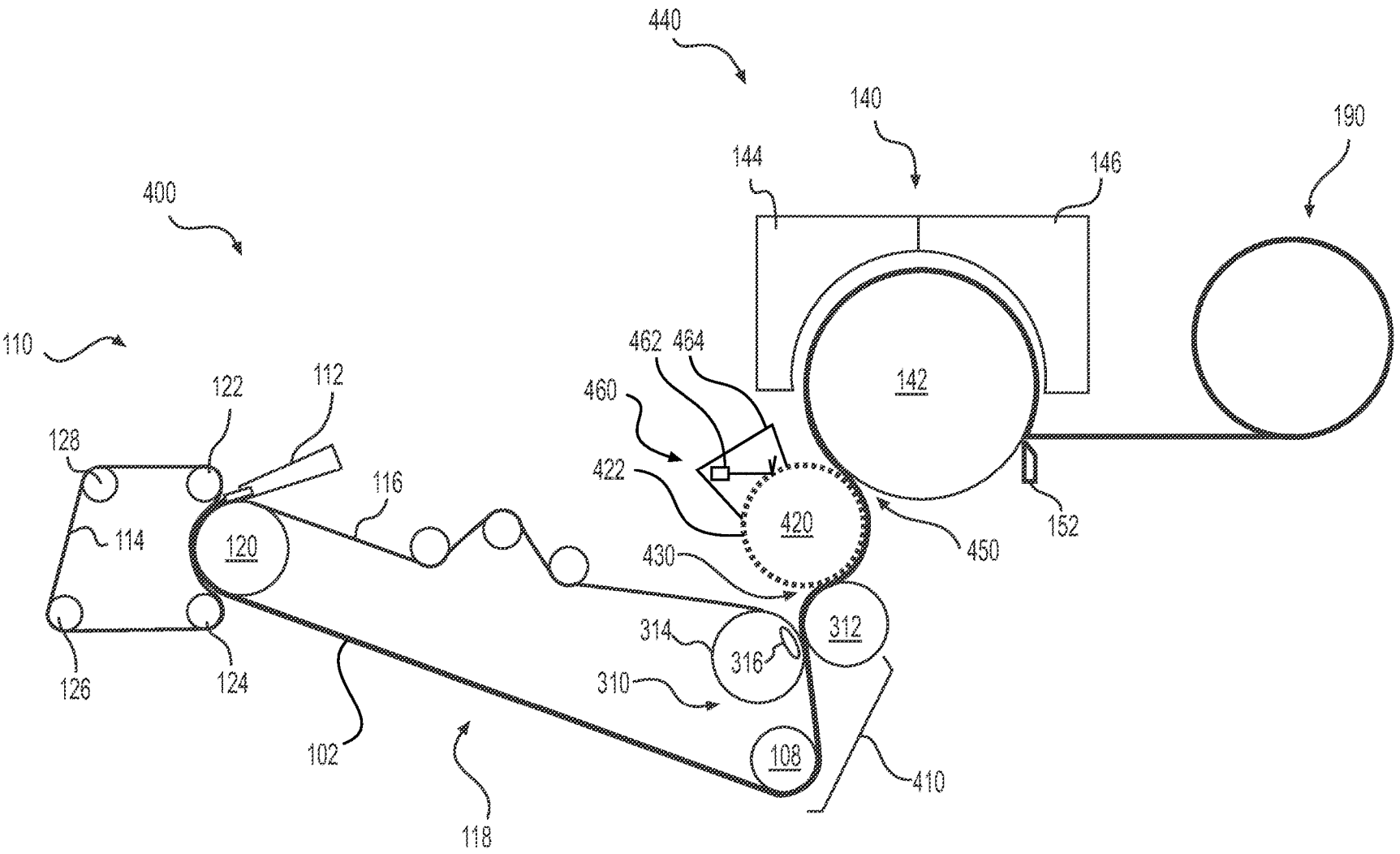
FIG. 4 is a schematic diagram of a papermaking machine configuration of a first preferred embodiment of my invention.

FIG. 4 shows a papermaking machine 400 used to create a paper web according to a first preferred embodiment of my invention. The forming section 110 of the papermaking machine 400 shown in FIG. 4 is a crescent former similar to the forming section 110 discussed above and shown in FIGS. 1 and 3. An example of an alternative to the crescent forming section 110 includes a twin-wire forming section 230, shown in FIG. 2. In such a configuration, downstream of the twin-wire forming section, the rest of the components of such a papermaking machine may be configured and arranged in a similar manner to that of papermaking machine 400. An example of a papermaking machine with a twin-wire forming section can be seen in, for example, U.S. Patent Application Pub. No. 2010/0186913 (the disclosure of which is incorporated by reference in its entirety). Still further examples of alternative forming sections that can be used in a papermaking machine include a C-wrap twin wire former, an S-wrap twin wire former, or a suction breast roll former. Those skilled in the art will recognize how these, or even still further alternative forming sections, can be integrated into a papermaking machine.

The nascent web 102 is then transferred along a felt run 118 to a dewatering section 410. In some applications, however, a dewatering section separate from the forming section 110 is not required, as will be discussed, for example, in the second embodiment below. The dewatering section 410 increases the solids content of the nascent web 102 to form a moist nascent web 102. The preferable consistency of the moist nascent web 102 may vary depending upon the desired application. In this embodiment, the nascent web 102 is dewatered to form a moist nascent web 102 having a consistency preferably between about twenty percent solids and about seventy percent solids, more preferably between about thirty percent solids to about sixty percent solids, and even more preferably between about forty percent solids to about fifty-five percent solids. The nascent web 102 is dewatered concurrently with being transferred from the papermaking felt 116 to a backing roll 312. The dewatering section 410 shown uses a shoe press roll 314 to dewater the nascent web 102 against the backing roll 312, as described above with reference to FIG. 3 and in, for example, U.S. Pat. No. 6,248,210 (the disclosure of which is incorporated by reference in its entirety). Those skilled in the art will recognize that the nascent web 102 may be dewatered using any suitable method known in the art including, for example, a roll press or a displacement press as described in my earlier patents, U.S. Pat. Nos. 6,161,303 and 6,416,631. As discussed further below, the nascent web 102 may also be dewatered using suction boxes and/or thermal drying. Also as discussed above with reference to FIG. 3, the surface of the backing roll 312 may be heated to assist with transferring the nascent web 102 to the molding roll 420. The backing roll 312 may be heated by using any suitable means including, for example, a steam heated roll or an induction heated roll, such as the induction heated roll produced by Comaintel of Grand-Mere, Québec, Canada. The surface of the backing roll 312 is preferably heated to temperatures between about two hundred twelve degrees Fahrenheit to about two hundred twenty degrees Fahrenheit.

After being dewatered, the moist nascent web 102 is transferred from the surface of the backing roll 312 to a molding roll 420 in a molding zone. In this embodiment, the molding zone is a molding nip 430 formed between the backing roll 312 and the molding roll 420. In the molding nip 430, the papermaking fibers are redistributed by a patterned surface 422 of the molding roll 420 resulting in a paper web 102 that has variable and patterned fiber orientations and variable and patterned basis weights. In particular, the patterned surface 422 preferably includes a plurality of recesses (or "pockets") and, in some cases, projections that produce corresponding protrusions and recesses in the molded web 102. The molding roll 420 is rotating in a molding roll direction, which is counterclockwise in FIG. 4.

The use of the molding roll 420 imparts substantial benefits to the papermaking process. Wet molding the web 102 with the molding roll 420 improves desirable sheet properties such as bulk and absorbency over paper products produced by CWP shown in FIG. 1 without the inefficiencies and cost of the TAD process shown in FIG. 2. In addition, the use of the molding roll 420 greatly reduces the complexity of the papermaking machine 400 and process as compared to processes that use belts to mold the web 102, such as creping belt 322 shown in FIG. 3. Belts are difficult to manufacture and are limited in the materials that can be used to make a belt with a patterned surface. Belts require the use of multiple rolls and many different moving parts, which make belt runs complex, difficult to operate, and introduce a greater number of points of failure. Belt runs also require a large amount of volume including floor space within the paper machine and factory. As a result, such belt runs can increase the costs of an already expensive piece of capital equipment. The molding roll 420 on the other hand is relatively less complex and requires minimal volume and floor space. Existing CWP machines (see FIG. 1) can be readily converted to a wet molding papermaking process by the addition of a molding roll 420 and a backing roll 312. Because the patterned surface 422 is on or part of the molding roll 420, it does not need to be designed to withstand bending and flexing that are required for belts.

In the first embodiment, the moist nascent web 102 may be transferred from the backing roll 312 to the molding roll 420 by a rush transfer. During a rush transfer, the molding roll 420 is traveling at a slower speed than the web 102 and the backing roll 312. In this regard, the web 102 is creped by the speed differential and the degree of creping is often referred to as the creping ratio. The creping ratio in this embodiment may be calculated according to Equation (1) as:

$$\text{Creping Ratio}(\%)=(S_1/S_2-1)\times 100\% \qquad \text{Equation (1)}$$

where $S_1$ is the speed of the backing roll 312 and $S_2$ is the speed of the molding roll 420. Preferably, the web 102 is creped at a ratio of about five percent to about sixty percent. But, high degrees of crepe can be employed, approaching or even exceeding one hundred percent. The creping ratio is often proportional to the degree of bulk in the sheet, but inversely proportional to the throughput of the paper machine and thus yield of the papermaking machine 400. In this embodiment, the velocity of the paper web 102 on the backing roll 312 may preferably be from about one thousand feet per minute to about six thousand five hundred feet per minute. More preferably velocity of the paper web 102 on the backing roll 312 is as fast as the process allows, which is typically limited by the drying section 440. For higher bulk product where a slower paper machine speeds can be accommodated, a higher creping ratio is used.

The molding nip 430 may also be loaded in order to effect sheet transfer and to control sheet properties. When rush transfer or other methods, such as vacuum transfer discussed in the third embodiment below, are used, it is possible to have little or no compression at the molding nip 430. When molding nip 430 is loaded, the backing roll 312 preferably applies a load to the molding roll 420 from about twenty pounds per linear inch ("PLI") to about three hundred PLI, more preferably from about forty PLI to about one hundred fifty PLI. But, for high strength, lower bulk sheets, those skilled in the art will appreciate that, in a commercial machine, the maximum pressure may be as high as possible, limited only by the particular machinery employed. Thus, pressures in excess of one hundred fifty PLI, five hundred PLI, or more may be used, if practical, and, when a rush transfer is used, provided the difference in speed between the backing roll 312 and the molding roll 420 can be maintained and sheet property requirements are met.

After being molded, the molded web 102 is transferred to a drying section 440 where the web 102 is further dried to a consistency of about ninety-five percent solids. The drying section 440 may principally comprise a Yankee dryer section 140. As discussed above, the Yankee dryer section 140 includes, for example, a steam filled drum 142 ("Yankee drum") that is used to dry the web 102. In addition, hot air from wet end hood 144 and dry end hood 146 is directed against the web 102 to further dry the web 102 as it is conveyed on the Yankee drum 142. The web 102 is transferred from the molding roll 420 to the Yankee drum 142 at a transfer nip 450. Although the papermaking machine 400 of this embodiment is shown with a direct transfer from the molding roll 420 to the drying section 440, other intervening processes may be placed between the molding roll 420 and drying section 440 without deviating from the scope of my invention.

In this embodiment, transfer nip 450 is also a pressure nip. Here, a load is generated between the Yankee drum 142 and the molding roll 420 preferably having a line loading of from about fifty PLI to about three hundred fifty PLI. The web 102 will then transfer from the surface of the molding roll 420 to the surface of the Yankee drum. At consistencies from about twenty-five percent to about seventy percent, it is sometimes difficult to adhere the web 102 to the surface of the Yankee drum 142 firmly enough so as to thoroughly remove the web 102 from the molding roll 420. In order to increase the adhesion between the web 102 and the surface of the Yankee drum 142 as well as improve crepe at doctor blade 152, an adhesive may be applied to the surface of the Yankee drum 142. The adhesive can allow for high velocity operation of the system and high jet velocity impingement air drying, and also allow for subsequent peeling of the web 102 from the Yankee drum 142. An example of such an adhesive is a poly(vinyl alcohol)/polyamide adhesive composition, with an example application rate of this adhesive being at a rate of less than about forty milligrams per meter squared of sheet. Those skilled in the art, however, will recognize the wide variety of alternative adhesives, and further, quantities of adhesives, that may be used to facilitate the transfer of the web 102 to the Yankee drum 142.

The web 102 is removed from the Yankee drum 142 with the help of a doctor blade 152. After being removed from the Yankee dryer section 140, is taken up by a reel (not shown) to form a parent roll 190. Those skilled in the art will also recognize that other operations may be performed on the papermaking machine 400, especially, downstream of the Yankee drum 142 and before the reel (not shown). These operations may include, for example, calendering and drawing.

With use, the patterned surface 422 of the molding roll 420 may require cleaning. Papermaking fibers and other substances may be retained on the patterned surface 422 and, in particular, the pockets. At any one time during operation, only a portion of the patterned surface 422 is contacting and molding the paper web 102. In the arrangement of rolls shown in FIG. 4, about half of the circumference of the molding roll 420 is contacting the paper web 102 and the other half (hereafter free surface) is not. A cleaning section 460 may then be positioned opposite to the free surface of the molding roll 420 to clean the patterned surface 422. Any suitable cleaning method and device known in the art may be used. The cleaning section 460 depicted in FIG. 4 is a needle jet such as JN Spray Nozzles made by Kadant of Westford, Mass. A nozzle 462 is used to direct a cleaning medium, such as a high pressure stream of water and/or a cleaning solution, toward the patterned surface 422 in a direction that opposes the rotating direction of the molding roll 420. The angle the cleaning medium flows is preferably between a line tangent to the patterned surface 422 at the point the cleaning medium strikes the patterned surface 422 and perpendicular to the patterned surface 422 at the same point. As a result, the cleaning medium then chisels and removes any particulate matter that has built-up on the patterned surface 422. The nozzle 462 and stream are located in an enclosure 464 to collect the cleaning medium and particulate matter. Enclosure 464 may be under vacuum to assist in collecting the cleaning medium and particulate matter.

II. Second Embodiment of a Papermaking Machine

Figure 5:
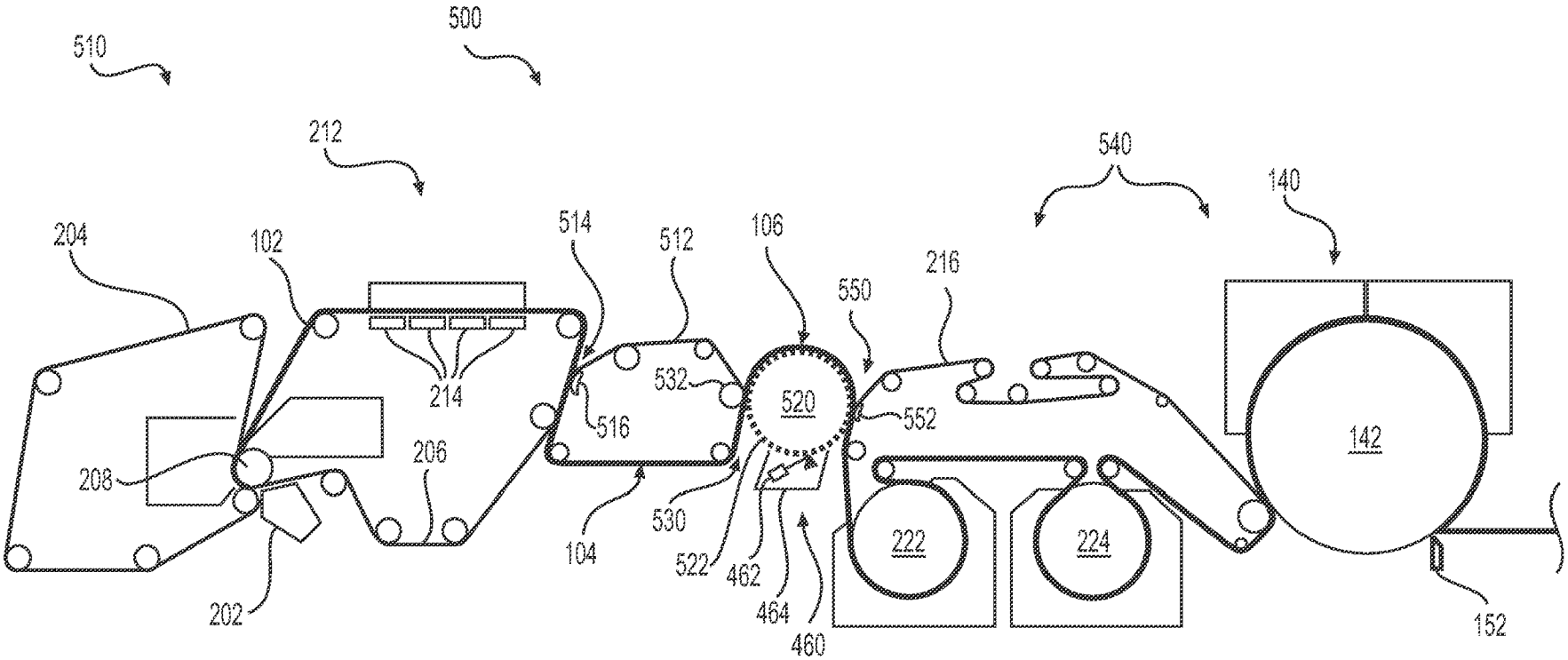
FIG. 5 is a schematic diagram of a papermaking machine configuration of the second preferred embodiment of my invention.

FIG. 5 shows a second preferred embodiment of my invention. It has been found that the lower the consistency of the moist nascent web 102 is when it is molded on the molding roll 420, the greater affect molding has on desirable sheet properties such as bulk and absorbency. Thus in general, it is advantageous to minimally dewater the nascent web 102 to increase sheet bulk and absorbency, and in some cases, the dewatering that occurs during forming may be sufficient for molding. When the web 102 is minimally dewatered, the moist nascent web 102 preferably has a consistency between about ten percent solids to about thirty-five percent solids, more preferably between about fifteen percent solids to about thirty percent solids. With such a low consistency, more of the dewatering/drying will occur subsequent to molding. Preferably, a non-compactive drying process will be used in order to preserve as much of the structure imparted to the web 102 during molding as possible. One suitable non-compactive drying process is the use of TAD. Among the various embodiments, the moist nascent web 102 may thus be molded over a range of consistencies extending from about ten percent solids to about seventy percent solids.

An example papermaking machine 500 of the second embodiment using a TAD drying section 540 is shown in FIG. 5. Although any suitable forming section 510 may be used to form and dewater the web 102, in this embodiment, the twin wire forming section 510 is similar to that discussed above with respect to FIG. 2. The web 102 is then transferred from the second forming fabric 206 to a transfer fabric 512 at transfer nip 514, where a shoe 516 presses the transfer fabric 512 against the second forming fabric 206. The shoe 516 may be a vacuum shoe that applies a vacuum to assist in the transfer of the web 102 to the transfer fabric 512. The wet web 102 then encounters a molding zone. In this embodiment, the molding zone is a molding nip 530 formed by roll 532, the transfer fabric 512, and the molding roll 520. In this embodiment, molding roll 520 and molding nip 530 are constructed and operated similarly to the molding roll 420 and molding nip 430 discussed above with reference to FIG. 4. For example, the web 102 may be rush transferred from the transfer fabric 512 to the molding roll 520 as discussed above and roll 532 maybe loaded into the molding roll 520 to control sheet transfer and sheet properties. When a speed differential is used, the creping ratio is calculated using Equation (2), which is similar to Equation (1), as follows:

$$\text{Creping Ratio}(\%)=(S_3/S_4-1)\times 100\% \qquad \text{Equation (2)}$$

where $S_3$ is the speed of the transfer fabric 512 and $S_4$ is the speed of the molding roll 520. Likewise, the molding roll 520 has a permeable patterned surface 522, which is similar to the patterned surface 422 of the molding roll 420, preferably having a plurality of recesses (or "pockets") and, in some cases, projections that produce corresponding protrusions and recesses in the molded web 102.

Alternatively, the nascent web 102 may be minimally dewatered with a separate vacuum dewatering zone 212 in which suction boxes 214 remove moisture from the web 102 to achieve desirable consistencies of about ten percent solids and about thirty-five percent solids before the sheet reaches molding nip 530. Hot air may also be used in dewatering zone 212 to improve dewatering.

After molding, the web 102 is then transferred from the molding roll 520 to a drying section 540 at a transfer nip 550. As in the papermaking machine 200 discussed above with reference to FIG. 2, a vacuum may be applied to assist in the transfer of the web 102 from the molding roll 520 to the through-air drying fabric 216 using a vacuum shoe 552 in the transfer nip 550. This transfer may occur with or without a speed difference between molding roll 520 and TAD fabric 216. When a speed differential is used, the creping ratio is calculated using Equation (3), which is similar to Equation (1), as follows:

$$\text{Creping Ratio}(\%)=(S_4/S_5-1)\times 100\% \qquad \text{Equation (3)}$$

where $S_4$ is the speed of the molding roll 520 and $S_5$ is the speed of the TAD fabric 216. When rush transfer is used in both the molding nip 530 and the transfer nip 550, the total creping ratio (calculated by adding the creping ratios in each nip) is preferably between about five percent to about sixty percent. But as with molding nip 430 (see FIG. 4), high degrees of crepe can be employed, approaching or even exceeding one hundred percent.

The TAD fabric 216 carrying the paper web 102 next passes around through-air dryers 222, 224 where hot air is forced through the web to increase the consistency of the paper web 102, to about eighty percent solids. The web 102 is then transferred to the Yankee dryer section 140, where the web 102 is further dried and, after being removed from the Yankee dryer section 140 by doctor blade 152, is taken up by a reel (not shown) to form a parent roll (not shown).

Wet molding the moist nascent web 102 on the molding roll 520 at consistencies between about ten percent solids to about thirty-five percent solids produces a premium product with the associated costs of TAD discussed above, but still retains the other advantages of using a molding roll 520 including increased bulk and reduced fiber cost.

Additionally, this configuration gives a means to control so-called sidedness of the sheet. Sidedness can occur when one side of the paper web 102 has (or is perceived to have) different properties on one side of the paper web 102 and not the other. With a paper web 102 made using a CWP paper machine (see FIG. 1), for example, the Yankee side of the paper web 102 may be perceived to be softer than the air side because, as the paper web 102 is pulled from the Yankee drum 142 by the doctor blade 152, the doctor blade 152 crepes the sheet more on the Yankee side of the sheet than on the air side of the sheet. In another example, when the paper web 102 is molded on one side, the side contacting the molding surface may have an increased roughness (e.g., deeper recesses and higher protrusions) as compared to the non-molded side. In addition, the side of a molded paper web 102 contacting the Yankee drum 142 may be further smoothed when it is applied the Yankee drum 142.

I have found that the molded structure imparted to the paper web 102 may not continue through the full thickness of the paper web 102. Transfer of the wet web 102 in molding nip 530 thus predominately molds a first side 104 of the paper web 102, and transfer in the transfer nip 550 predominately molds a second side 106 of the paper web 102. Individually controlling the nip parameters at both the molding nip 530 and the transfer nip 550 can counteract sidedness. For example, the patterned surface 522 of the molding roll 520 may be designed with pockets and projections that impart recesses and protrusions that are deeper and higher, respectively, on the first side 104 of the paper web 102 (prior to the paper web 102 being applied to the Yankee drum 142) than are imparted by the TAD fabric 216 to the second side 106 of the paper web 102. Then, when the first side 104 of the paper web 102 is applied to the Yankee drum 142, the Yankee drum 142 will smooth the first side 104 of the paper web 102 by reducing the height of the protrusions such that, when the paper web 102 is peeled from the Yankee drum 142 by the doctor blade 152, both the first and second sides 104, 106 of the paper web 102 have substantially the same properties. For example, a user may perceive that both sides have the same roughness and softness, or commonly measured paper properties are within normal control tolerances for the paper product. Counteracting sidedness is not limited to adjusting the patterned structure of the molding roll 520 and the TAD fabric 216. Sidedness can also be counteracted by controlling other nip parameters including the creping ratio and/or the loading of each nip 530, 550.

III. Third Embodiment of a Papermaking Machine

Figure 6A:
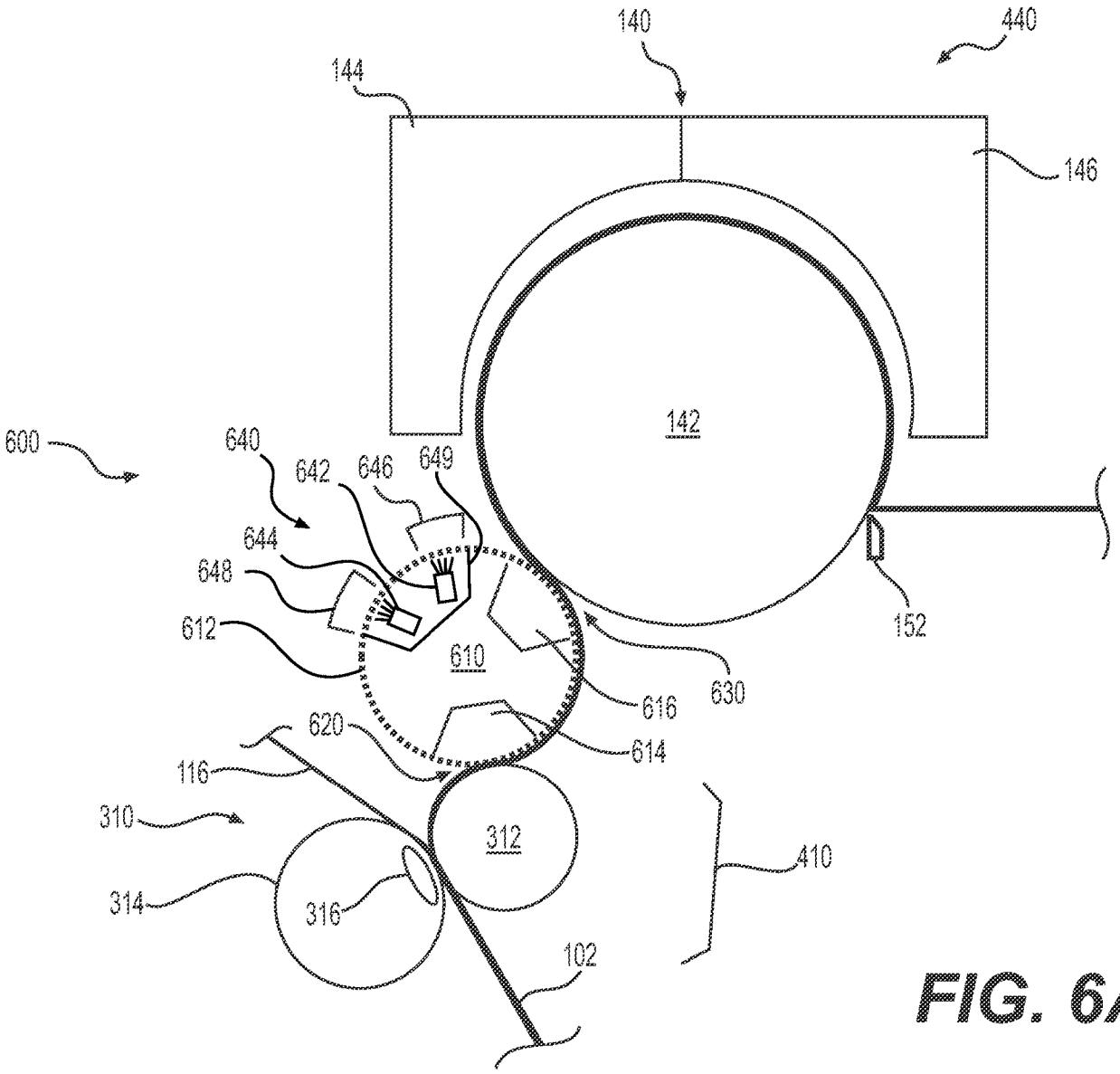
FIGS. 6A and 6B are schematic diagrams of a portion of a papermaking machine configuration of a third preferred embodiment of my invention.
Figure 6B:
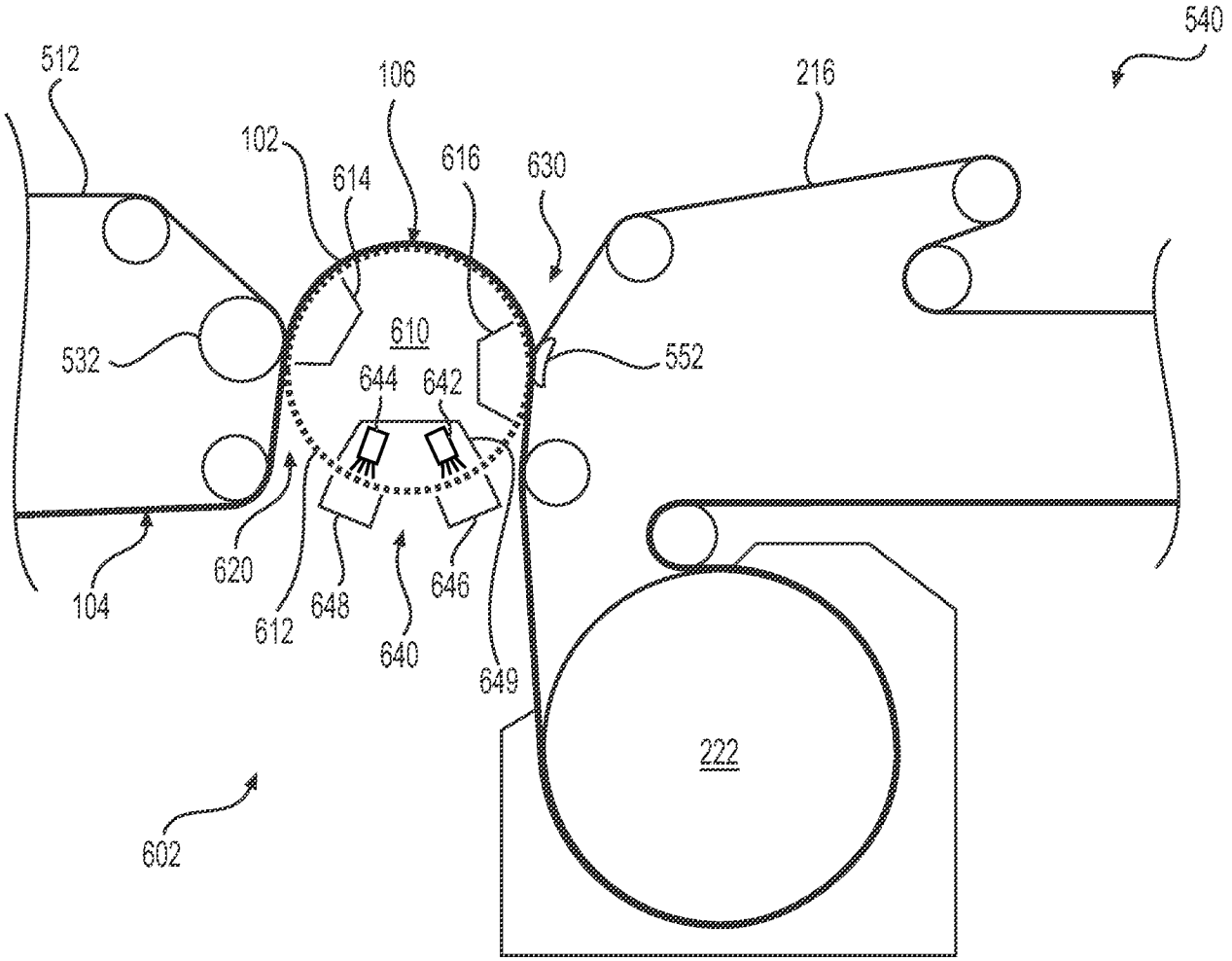

FIGS. 6A and 6B show a third preferred embodiment of my invention. As shown in FIG. 6A, the papermaking machine 600 of the third embodiment may have the same forming section 110, dewatering section 410, and drying section 440 as the papermaking machine 400 of the first embodiment shown in FIG. 4. Or, as shown in FIG. 6B, the papermaking machine 602 of the third embodiment may have the same forming section 510 and drying section 540 of the second embodiment shown in FIG. 5. The descriptions of those sections are omitted here. As with the molding rolls 420, 520 of the first and second embodiments (see FIGS. 4 and 5, respectively), the molding roll 610 of the third embodiment has a patterned surface 612 preferably having a plurality of recesses ("pockets"). To improve sheet transfer and sheet molding, the molding roll 610 of the third embodiment uses a pressure differential to aid the transfer of the web 102 from the backing roll 312 or transfer fabric 512 to the molding roll 610. In this embodiment, the molding roll 610 has a vacuum section ("vacuum box") 614 located opposite to the backing roll 312 in FIG. 6A or roll 532 in FIG. 6B in a molding zone. In the embodiments shown in FIGS. 6A and 6B, the molding zone is molding nip 620. The patterned surface 612 is permeable such that a vacuum box 614 can be used to establish a vacuum in the molding nip 620 by drawing a fluid through the permeable patterned surface 612. The vacuum in the molding nip 620 draws the paper web 102 onto the permeable patterned surface 612 of the molding roll 610 and, in particular, into the plurality of pockets in the permeable patterned surface 612. The vacuum thus molds the paper web 102 and reorients the papermaking fibers in the paper web 102 to have variable and patterned fiber orientations.

In other wet molding processes, such as fabric creping (shown in FIG. 3), a vacuum is applied subsequent to the transfer to the creping belt 322 by vacuum box 324. In this embodiment, however, a vacuum is applied as the paper web 102 is transferred. By applying the vacuum during the transfer, both the mobility of the fibers during transfer and the pull of the vacuum increases the depth of fiber penetration into the pockets of the permeable patterned surface 612. The increased fiber penetration results in an improved sheet molding amplitude and a greater impact of wet molding on resultant web properties, such as improved bulk.

The use of a vacuum transfer allows the molding nip 620 to utilize reduced or no nip loading. Vacuum transfer may thus be a less-compactive or even a non-compactive process. Compaction may be reduced or avoided between the projections of patterned surface 612 and the papermaking fibers located in the corresponding recesses formed in the web 102. As a result, the paper web 102 may have a higher bulk than one made from a compactive process, such as fabric creping (shown in FIG. 3) or CWP (shown in FIG. 1). Reducing the loading at, or not loading, the molding nip 620 can also reduce the amount of wear between the backing roll 312 or transfer fabric 512 and the molding roll 610, as compared to wear between the backing roll 312 and the creping belt 322 shown in FIG. 3. Reducing wear is especially important for nips that employ rush transfer because increasing crepe ratios (%) and/or increasing crepe roll loadings tend to increase wear and thus can lead to reduced runtimes.

Another advantage of using vacuum at the point of transfer is flexibility in the use of release agents on the backing roll 312 or transfer fabric 512. In particular, release agents can be reduced or even eliminated. As discussed above, the paper web 102 tends to stick to the smoother of two surfaces during a transfer. Thus, release agents are preferably used in fabric creping to assist in the transfer of the paper web 102 from the backing roll 312 to the creping belt 322 (see FIG. 3). Release agents require careful formulation in order to work. They also can build up on the backing roll 312 or can be retained in the paper web 102. The use of release agents adds complexity to the papermaking process, reduces the runability of the paper machine when they are not effective, and may be deleterious to the paper web 102 properties. In this embodiment, all of these issues can thus be avoided by using vacuum at the point of transfer from the backing roll 312 or transfer fabric 512 to the molding roll 610.

As discussed in the second embodiment, it is preferable for some applications to wet crepe the moist nascent web 102 when it is very wet (e.g., at consistencies from about ten percent solids to about thirty-five percent solids). Webs having these low solid contents may be difficult to transfer. I have found that these very wet webs may be effectively transferred using vacuum at the point of transfer. And, thus, still another advantage of molding roll 610 is the ability to wet crepe very wet moist nascent webs 102 using vacuum box 614.

The vacuum level in the molding nip 620 is suitably large enough to draw the paper web 102 from the backing roll 312 or transfer fabric 512. Preferably, the vacuum is from about zero inches of mercury to about twenty-five inches of mercury, and more preferably from about ten inches of mercury to about twenty-five inches of mercury.

Likewise, the MD length of the vacuum zone of the molding roll 610 is large enough to draw the paper web 102 from the backing roll 312 or transfer fabric 512 and into the molding surface 612. Such MD lengths may be as small as about two inches or less. The preferable lengths may depend on the rotational speed of the molding roll 610. The web 102 is preferably subject to vacuum for a sufficient amount of time to draw the papermaking fibers into the pockets. As a result, the MD length of the vacuum zone is preferably increased as the rotational speed of the molding roll 610 is increased. The upper limit of MD length of the vacuum box 614 is driven by the desire to reduce energy consumption and maximize the area within the molding roll 610 for other components such as a cleaning section 640. Preferably, the MD length of the vacuum zone is from about a quarter of an inch to about five inches, more preferably from about a quarter of an inch to about two inches.

Those skilled in the art will recognize that the vacuum zone is not limited to a single vacuum zone, but a multi-zone vacuum box 614 may be used. For example, it may be preferable to use a two stage vacuum box 614 in which the first stage exerts a high level vacuum to draw the paper web 102 from the backing roll 312 or transfer fabric 512 and the second stage exerts a lower level vacuum to mold the paper web 102 by drawing it against the permeable patterned surface 612 and the pockets therein. In such a two stage vacuum box, the MD length and vacuum level of the first stage is preferably just large enough to effect transfer of the paper web 102. The MD length of the first stage is preferably from about a quarter of an inch to about five inches, more preferably from about a half of an inch to about two inches. Likewise, the vacuum is preferably from about zero inches of mercury to about twenty-five inches of mercury, and more preferably from about ten inches of mercury to about twenty inches of mercury. The MD length of the second stage is preferably larger than the first. Because vacuum is applied to the paper web 102 over a longer distance, the vacuum can be reduced resulting in a paper web 102 having higher bulk. The MD length of the second stage is preferably from about a quarter of an inch to about five inches, more preferably from about a half of an inch to about two inches. Likewise, the vacuum is preferably from about ten inches of mercury to about twenty-five inches of mercury, and more preferably from about fifteen inches of mercury to about twenty-five inches of mercury.

By drawing a vacuum in molding nip 620, the moist nascent web 102 may be advantageously dewatered. The vacuum draws out water from the moist nascent web 102, as the web 102 travels on the permeable patterned surface 612 through the vacuum zone (vacuum box 614). Those skilled in the art will recognize that the degree of dewatering is a function of several considerations including the dwell time of the moist nascent web 102 in the vacuum zone, the strength of the vacuum, the crepe nip load, the temperature of the web, and the initial consistency of the moist nascent web 102.

Those skilled in the art will recognize, however, that the molding nip 620 is not limited to this design. Instead, for example, features of the molding nip 430 of the first embodiment or molding nip 530 of the second embodiment may be incorporated with the molding roll 610 of the third embodiment. For example, it may be desirable to even further increase the bulk of the paper web 102 by combining the molding roll 610 having the vacuum box 614 with a rush transfer, which further crepes the web 102, and the vacuum molds it at the same time.

The molding roll 610 of the third embodiment may also have a blow box 616 at transfer nip 630 where the web 102 is transferred from the permeable patterned surface 612 of the molding roll 610 to the surface of the Yankee drum 142 or TAD fabric 216. Although blow box 616 provides several benefits in transfer nip 630, the web may be transferred to the drying section 440, 540 without it, as discussed above with reference to transfer nip 450 (see FIG. 4) or transfer nip 550 of (see FIG. 5). When the drying section is a TAD drying section (see FIG. 6B), the web 102 may be transferred in the transfer nip 550 using the blow box 616, the vacuum shoe 552, or both.

Positive air pressure may be exerted from the blow box 616 through the permeable patterned surface 612 of the molding roll 610. The positive air pressure facilitates the transfer of the molded web 102 at transfer nip 630 by pushing the web away from the permeable patterned surface 612 of the molding roll 610 and towards the surface of the Yankee drum 142 (or TAD fabric 216). The pressure in the blow box 616 is set at a level consistent with good transfer of the sheet to the drying section 440, 540 and is dependent on box size, and roll construction. There should be enough pressure drop across the sheet to cause it to release from the patterned surface 612. The MD length of the blow box 616 is preferably from about a quarter of an inch to about five inches, more preferably from about a half of an inch to about two inches.

By using a blow box 616, the contact pressure between the molding roll 610 and the Yankee drum 142 or TAD fabric 216 may be reduced or even eliminated, thus resulting in less compaction of the web 102 at contact points, thus higher bulk. In addition, the air pressure from the blow box 616 urges the fibers at the permeable patterned surface 612 to transfer with the rest of the web 102 to the Yankee drum 142 or TAD fabric 216, thus reducing fiber picking. Fiber picking may cause small holes (pin holes) in the web 102.

Another advantage of the blow box 616 is that it assists in maintaining and cleaning the patterned surface 612. The positive air pressure through the roll can help to prevent the accumulation of fibers and other particulate matter on the roll.

As with the molding rolls 420, 520 of the first and second embodiments, a cleaning section 640 may be constructed opposite to the free surface of the molding roll 610 (e.g., cleaning section 460 as shown in FIG. 4). Any suitable cleaning method and device known in the art may be used, including the needle jet discussed above. As an alternative to, or in combination with, a cleaning section 460 constructed opposite to the free surface, a cleaning section may be constructed inside the molding roll 610 in the section of the molding roll 610 having the free surface. An advantage of the permeable patterned surface 612 is that cleaning devices may be placed on the interior of the molding roll to clean by directing a cleaning solution or cleaning medium outward. Such a cleaning device may include a blow box (not shown) or an air knife (not shown) that forces pressurized air (as the cleaning medium) though the permeable patterned surface 612. Another suitable cleaning device may be showers 642, 644 located in the molding roll 610. The showers 642, 644 may spray water and/or a cleaning solution outward through the permeable patterned surface 612. Preferably, vacuum boxes 646, 648 are positioned opposite to each shower 642, 644 on the exterior to collect the water and/or cleaning solution. Likewise, a receptacle 649, which may be a vacuum box, encloses the showers 642, 644 to collect any water and/or cleaning solution that remains in the interior of the molding roll 610.

IV. Fourth Embodiment of a Papermaking Machine

Figure 7A:
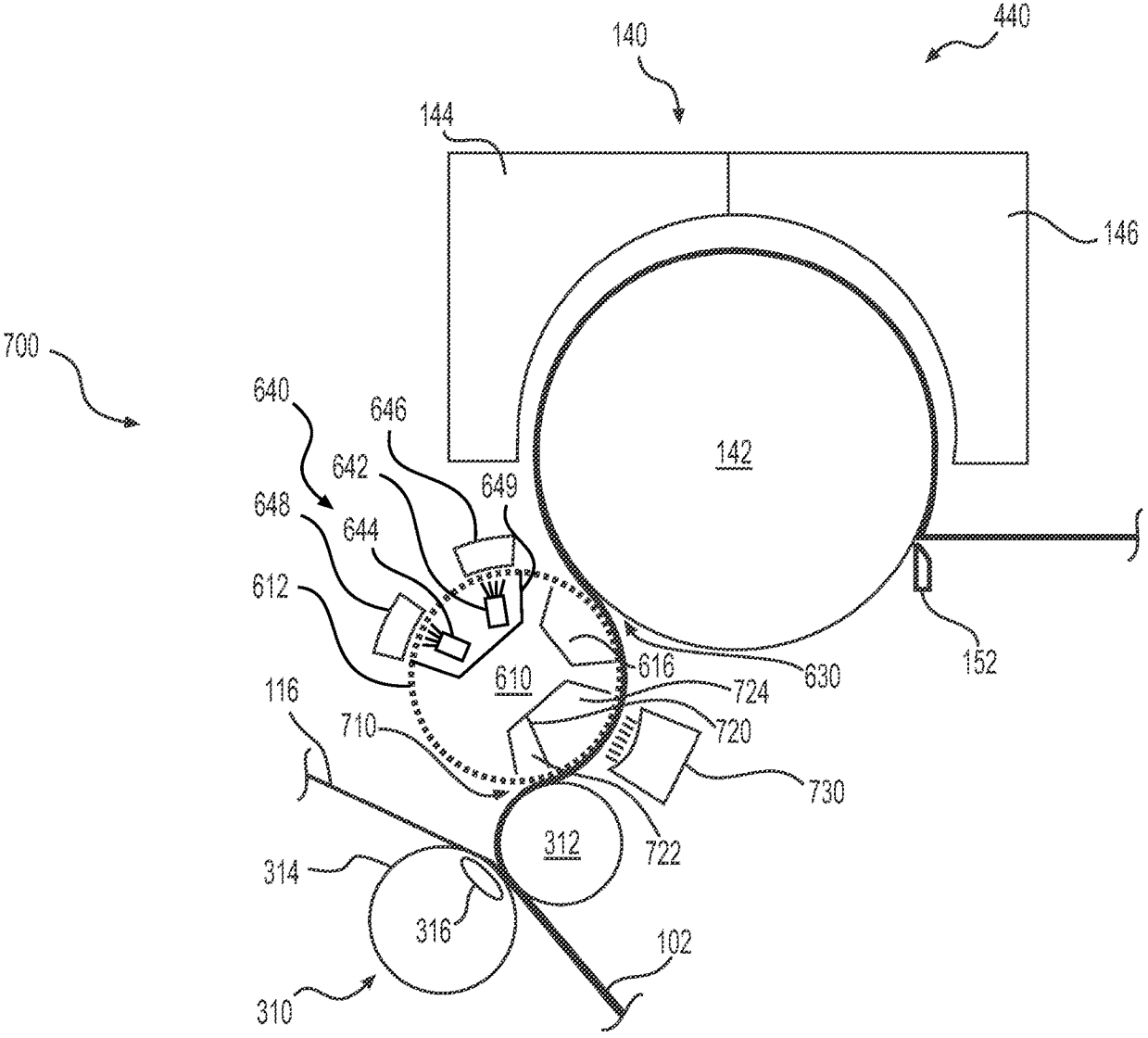
FIGS. 7A and 7B are schematic diagrams of a portion of a papermaking machine configuration of a fourth preferred embodiment of my invention.
Figure 7B:
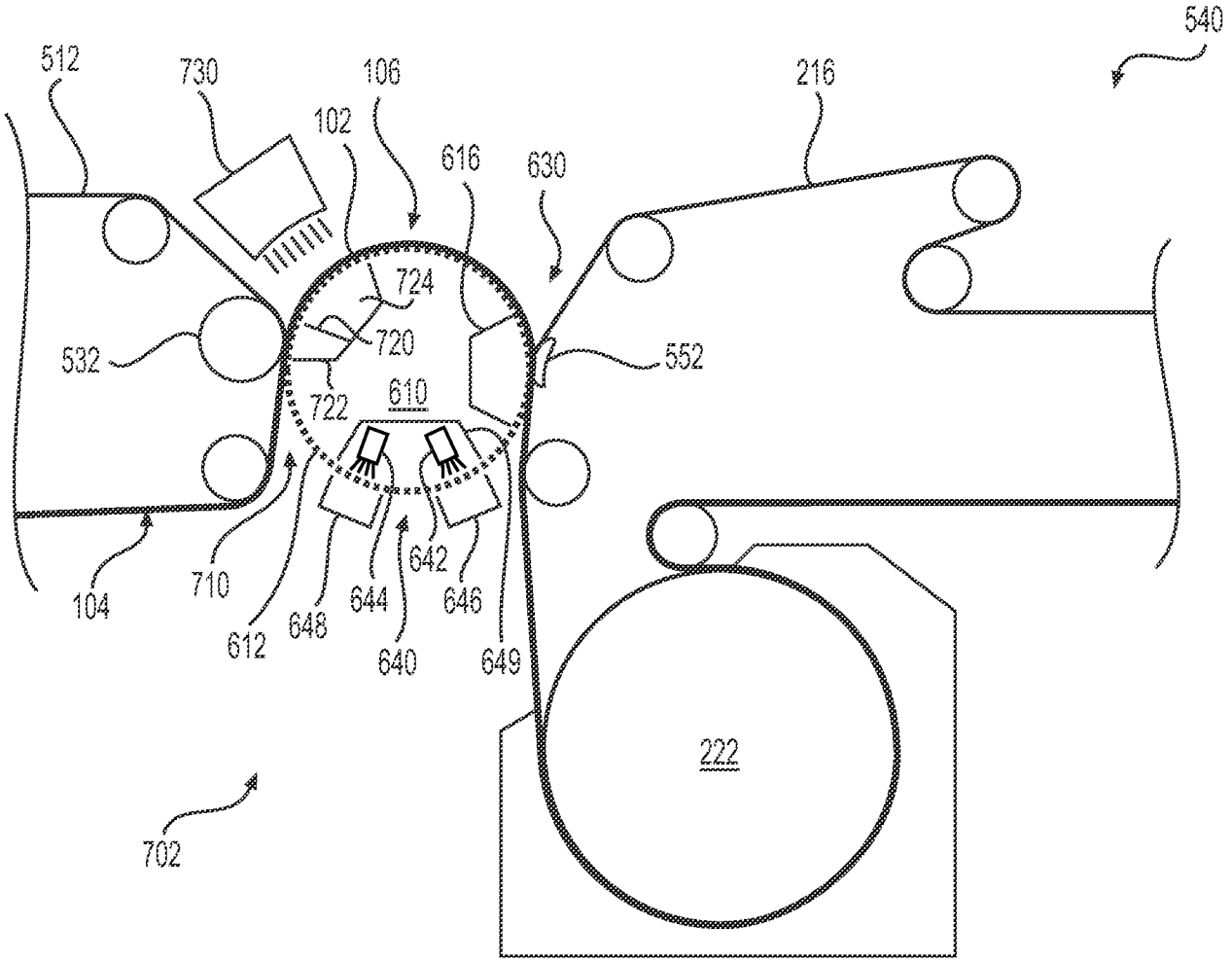

FIGS. 7A and 7B show a fourth embodiment of my invention. As discussed above, molding may be improved by increasing the mobility of the papermaking fibers in the molding zone, which is a molding nip 710 in this embodiment. I have found that one way to increase the mobility of the papermaking fibers is to heat the moist nascent web 102. The papermaking machines 700, 702 of the fourth embodiment are similar to the papermaking machines 600, 602 (see FIGS. 6A and 6B, respectively) of the third embodiment, but includes features to heat the moist nascent web 102.

In this embodiment, the vacuum box 720 is a dual zone vacuum box, having a first vacuum zone 722 and a second vacuum zone 724. The first vacuum zone 722 is positioned opposite to the backing roll 312 or roll 532 and is used to transfer the moist nascent web 102 from the backing roll 312 or transfer fabric 512 to the molding roll 610. The first vacuum zone 722 is preferably shorter and uses a greater vacuum than the second vacuum zone 724. The first vacuum zone 722 is preferably less than about two inches and preferably draws a vacuum between about two inches of mercury and about twenty-five inches of mercury.

In this embodiment, the nascent web 102 is heated on the molding roll 610 using a steam shower 730. Any suitable steam shower 730 may be used with my invention including, for example, a Lazy Steam injector manufactured by Wells Enterprises of Seattle Wash. The steam shower 730 is positioned proximate to the molding nip 710 and opposite to the second vacuum zone 724 of the vacuum box 720. The steam shower 730 generates steam (for example saturated or superheated steam). The steam shower 730 directs the steam toward the moist nascent web 102 on the patterned surface 612 of the molding roll 610 and the second vacuum zone 724 of the vacuum box 720 uses a vacuum to draw the steam though the web 102, thus, heating the web 102 and the papermaking fibers therein. The second vacuum zone 724 is preferably from about two inches to about twenty-eight inches and preferably draws a vacuum between about five inches of mercury and about twenty-five inches of mercury. Although, the steam shower 730 may be suitably used without a vacuum zone. The temperature of the steam is preferably from about two hundred twelve degrees Fahrenheit to about two hundred twenty degrees Fahrenheit. Any suitable heated fluid may be emitted by the steam shower, including, for example, heated air or other gas.

Heating the moist nascent web 102 in the molding nip 710 is not limited to a heated fluid emitted from a steam shower 730. Instead, other techniques to heat the moist nascent web 102 may be used including, for example, heated air, a heated backing roll 312, or heating the molding roll 420, 520, 610 itself. The molding roll 420, 520, 610, and in particular the molding roll 420, 520 of the first and second embodiments, may be heated like the backing roll 312 by using any suitable means including, for example, steam or induction heating. By using air, for example, the moist nascent web 102 may be heated and dried while being molded on the molding rolls 420, 520 of the first and second embodiments.

V. Fifth Embodiment of a Papermaking Machine

Figure 8:
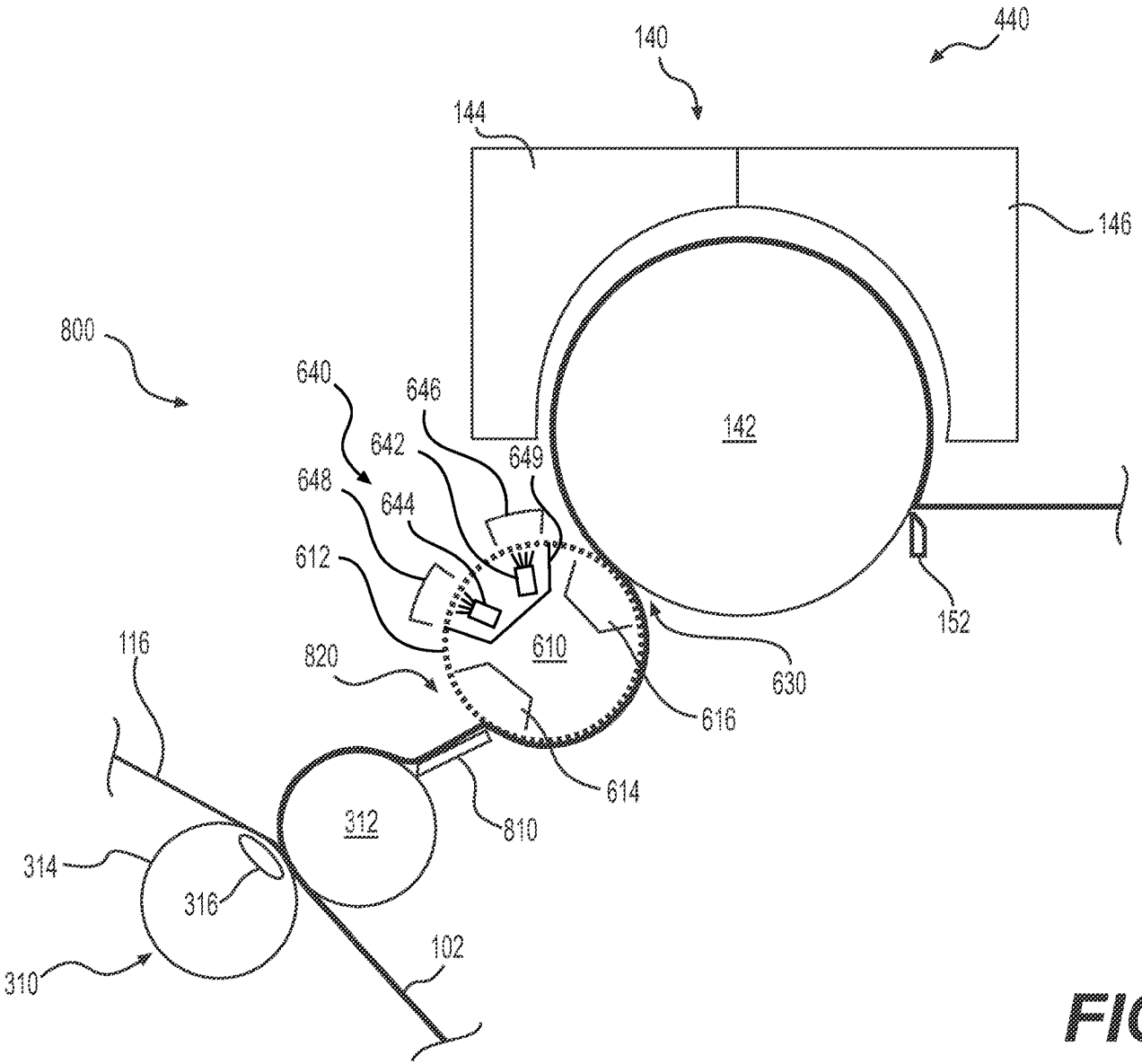
FIG. 8 is a schematic diagram of a portion of a papermaking machine configuration of a fifth preferred embodiment of my invention.

FIG. 8 shows a fifth embodiment of my invention. The papermaking machine 800 of the fifth embodiment is similar to the papermaking machine 600 (see FIG. 6A) of the third embodiment, but includes a doctor blade 810 at the molding zone 820. The doctor blade 810 is used to peel the web from the backing roll 312 and to facilitate transfer of the web 102 to the molding roll 610. When the sheet is removed from the backing roll 312, by the doctor blade 810, it introduces crepe to the web, which is known to increase sheet caliper and bulk. Thus, implementation of this embodiment provides the ability to add additional bulk to the overall process. Furthermore, sheet transfer by the doctor blade 810 removes the need for contact between the backing roll 312 and the molding roll 610 because the vacuum box 614 in the molding roll 610 will effect sheet transfer to the patterned surface 612 without roll contact. By removing the need for roll to roll contact to effect sheet transfer, roll wear is reduced, especially when there are speed differences between the rolls. The doctor blade 810 may oscillate to further crepe the web 102 at the molding zone 820. Any suitable doctor blade 810 may be used with my invention, including, for example, the doctor blade disclosed in U.S. Pat. No. 6,113,470 (the disclosure of which is incorporated by reference in its entirety).

VI. Sixth Embodiment of a Papermaking Machine

Figure 9A:
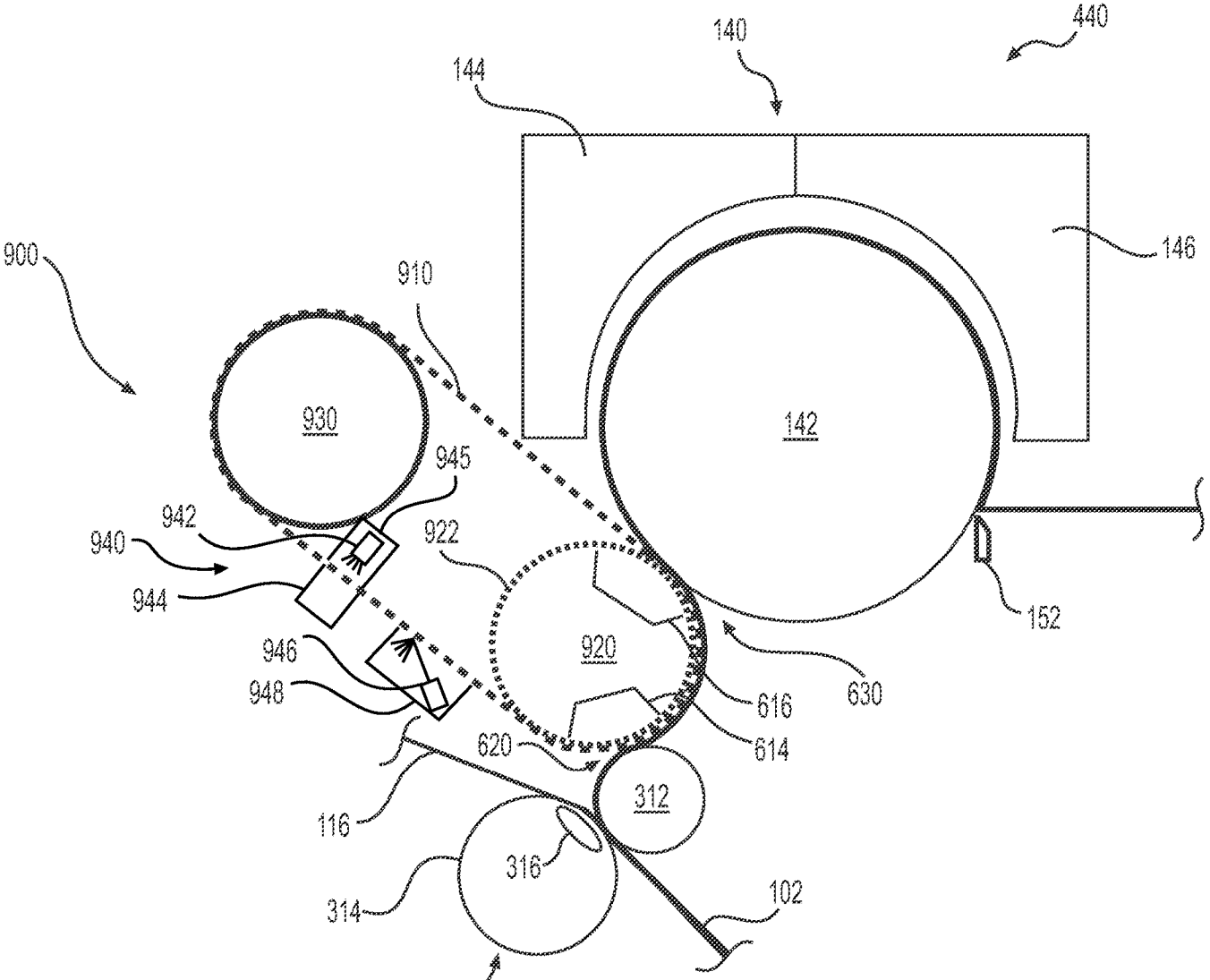
FIGS. 9A and 9B are schematic diagrams of a portion of a papermaking machine configuration of a sixth preferred embodiment of my invention.
Figure 9B:
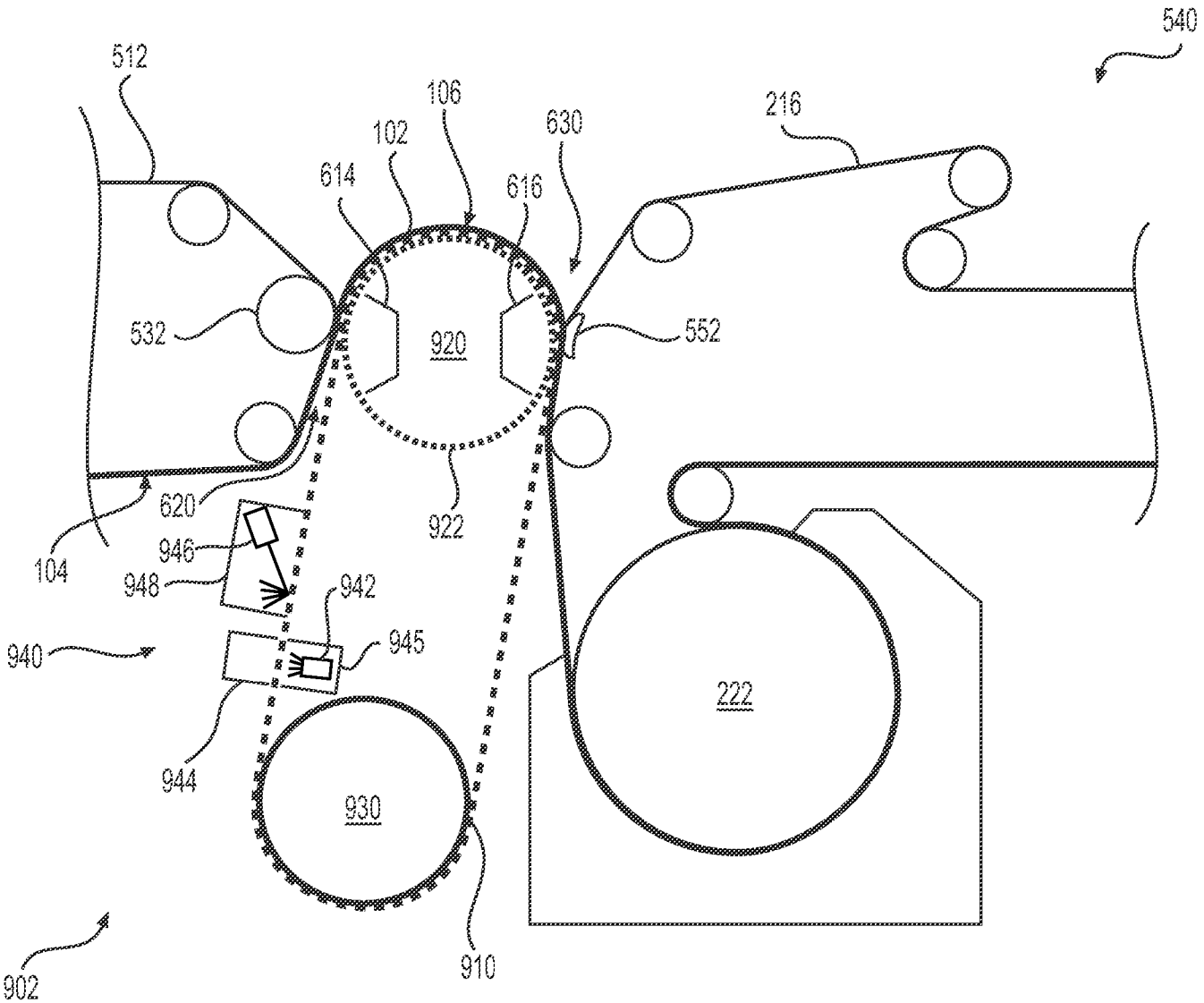

FIGS. 9A and 9B show a sixth embodiment of my invention. The papermaking machines 900, 902 of the sixth embodiment are similar to the papermaking machines 600, 602 of the third embodiment (FIGS. 6A and 6B, respectively). Instead of the molding roll having a patterned outer surface (e.g., permeable patterned surface 612 of the molding roll 610 in FIGS. 6A and 6B), a molding fabric 910 is used and the molding fabric 910 is patterned to impart structure to the moist nascent web 102 like the permeable patterned surface 612 discussed in the third, fourth, and fifth embodiments. The molding fabric 910 is supported on one end by a molding roll 920 and a support roll 930 on the other end. The molding roll 920 has a permeable shell 922 (as will be discussed further below). The permeable shell 922 allows a vacuum box 614 and a blow box 616 to be used, as discussed above in the third embodiment.

As with the previous embodiments, this embodiment includes a cleaning section 940. Because of the additional space afforded by the molding fabric 910, the cleaning section 940 may be located on the fabric run between the molding roll 920 and the support roll 930. Any suitable cleaning device may be used. Similar to the third embodiment, a shower 942 enclosed in a receptacle 945 may be positioned on an interior of the fabric run to direct water and/or a cleaning solution outward through the molding fabric 910. A vacuum box 944 may be located opposite to the shower 942 to collect the water and/or cleaning solution. Similar to the first and second embodiments, a needle jet may also be used in an enclosure 948 to direct water and/or a cleaning solution at an angle from a nozzle 946. Enclosure 948 maybe under vacuum to collect the solution emitted by the spray nozzle 946.

VII. Seventh Embodiment of a Papermaking Machine

Figure 10A:
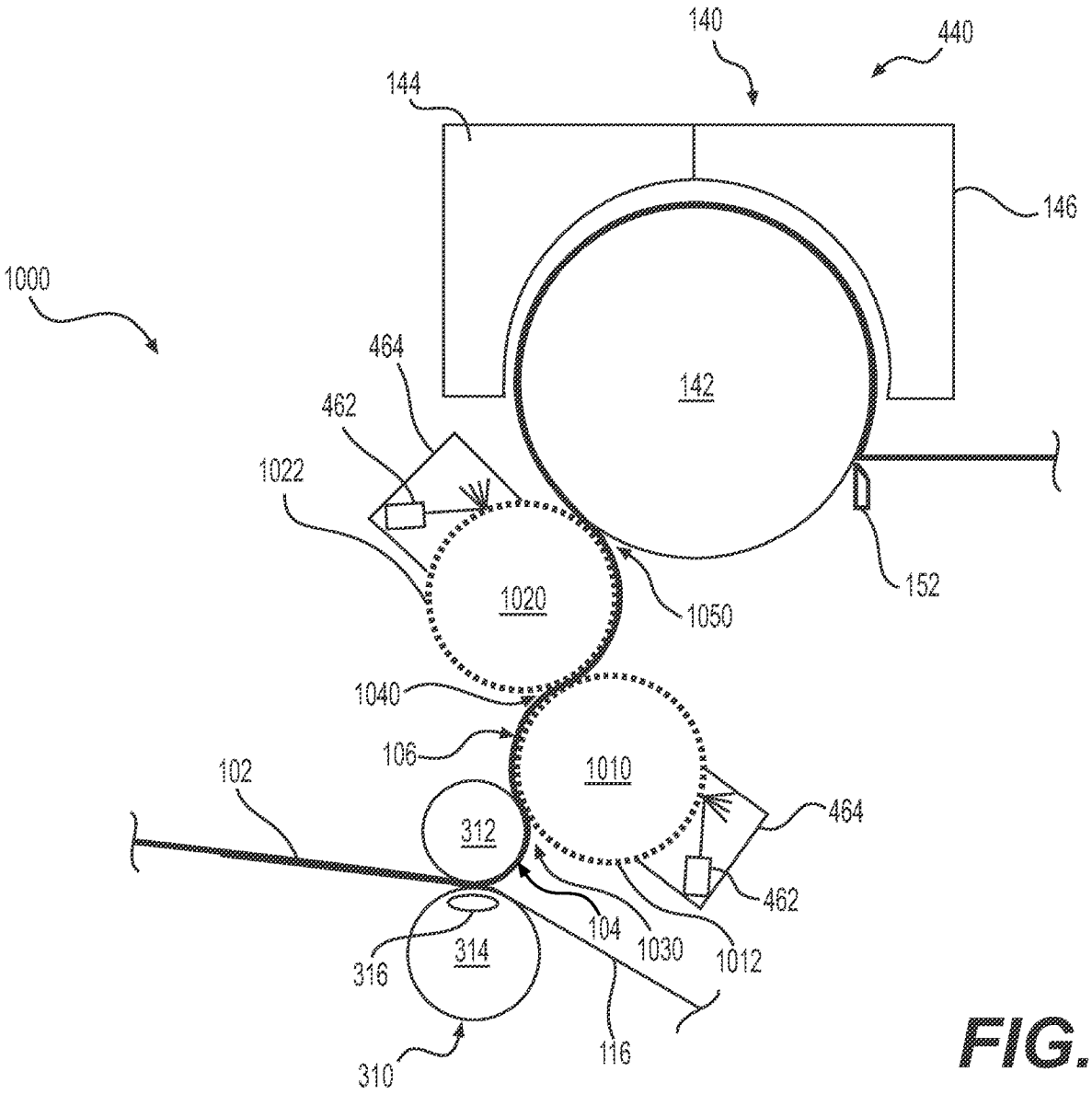
FIGS. 10A and 10B are schematic diagrams of a portion of a papermaking machine configuration of a seventh preferred embodiment of my invention.
Figure 10B:
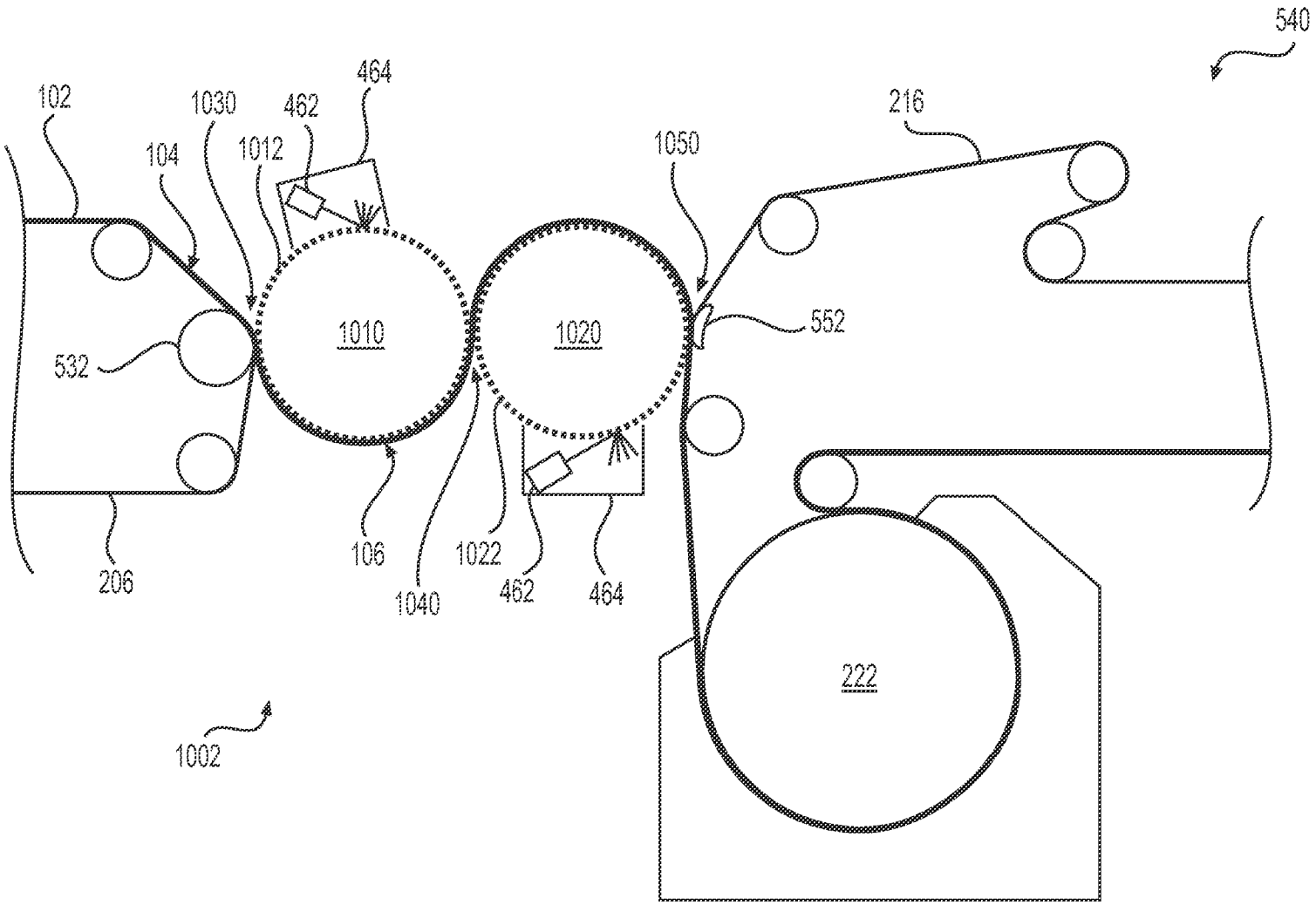

FIGS. 10A and 10B show a seventh embodiment of my invention. The papermaking machine 1000 shown in FIG. 10A is similar to the papermaking machine 400 of the first embodiment. Likewise, the papermaking machine 1002 shown in FIG. 10B is similar to the papermaking machine 500 of the second embodiment. In these papermaking machines 1000, 1002, two molding rolls 1010, 1020 are used instead of one. The first molding roll 1010 is used to structure one side (a first side 104) of the paper web 102 using a patterned surface 1012, and the second molding roll 1020 is used to structure the other side (a second side 106) using a patterned surface 1022. Molding both surfaces of the web 102 may have several advantages; for example, it may be possible to achieve the benefits of a two-ply paper product with only a single ply, since each side of the sheet can be independently controlled by the two molding rolls 1010, 1020. Also, individually molding each side of the paper web 102 may also help to reduce sidedness. In the papermaking machine 1002 shown in FIG. 10B, having two molding rolls 1010, 1020 also enables the wet web 102 to be directly transferred to the first molding roll 1010 from the second forming fabric 206 and the transfer fabric 512 of FIG. 5 to be omitted.

As discussed above in the second embodiment, I have found that the molded structure imparted to the paper web 102 by each molding roll 1010, 1020 may not continue through the full thickness of the paper web 102. The sheet properties of each side of the paper web 102 may thus be individually controlled by the corresponding molding roll 1010, 1020. For example, the patterned surfaces 1012, 1022 of each molding roll 1010, 1020 may have a different construction and/or pattern to impart a different structure to each side of the paper web 102. Although there are advantages to constructing each molding roll 1010, 1020 differently, the construction is not so limited, and the molding rolls 1010, 1020, particularly, the patterned surfaces 1012, 1022, may be constructed the same.

Sidedness can be counteracted by individually controlling the structure of each side of the molded paper web 102 with the two different molding rolls 1010, 1020 of this embodiment. For example, the patterned surface 1012 of the first molding roll 1010 may have deeper pockets and higher projections than the patterned surface 1022 of the second molding roll 1020. In this way, the first side 104 of the paper web 102 will have recesses and protrusions that are deeper and higher than the second side 106 of the paper web 102 prior to the paper web 102 being applied to the Yankee drum 142. Then, when the first side 104 of the paper web 102 is applied to the Yankee drum 142, the Yankee drum 142 will smooth the first side 104 of the paper web 102 by reducing the height of the protrusions such that, when the paper web 102 is peeled from the Yankee drum 142 by the doctor blade 152, both the first and second sides 104, 106 of the paper web 102 have substantially the same properties. For example, a user may perceive that both sides have the same roughness and softness, or commonly measured paper properties are within normal control tolerances for the paper product.

In this embodiment, the paper web 102 is transferred from the backing roll 312 or second forming fabric 206 in a first molding zone, which is a first molding nip 1030 in this embodiment. The same considerations that apply to the features of the molding nips 430, 530 (see FIGS. 4 and 5) in the first and second embodiments apply to the first molding nip 1030 of this embodiment.

After the first side 104 of the paper web 102 is molded by the first molding roll 1010, the paper web 102 is then transferred from the first molding roll 1010 to the second molding roll 1020 in a second molding zone, which is a second molding nip 1040 in this embodiment. The paper web 102 may be transferred in both molding nips 1030, 1040 by, for example, rush transfer. Similar to Equations (1) and (2), the creping ratio in this embodiment for each nip 1030, 1040 may be calculated according to Equations (4) and (5) as:

$$\text{Creping Ratio One}(\%)=(S_1/S_6-1)\times 100\% \qquad \text{Equation (4)}$$

$$\text{Creping Ratio Two}(\%)=(S_6/S_7-1)\times 100\% \qquad \text{Equation (5)}$$

where $S_1$ is the speed of the backing roll 312 or second forming fabric 206, $S_6$ is the speed of the first molding roll 1010 and $S_7$ is the speed of the second molding roll 1020. Preferably, the web 102 is creped in each of the two molding nips 1030, 1040 at a ratio of about five percent to about sixty percent. But, high degrees of crepe can be employed, approaching or even exceeding one hundred percent. A unique opportunity exists with two molding nips that can be used to further modify sheet properties. Since each crepe ratio primarily affects the side of the sheet being molded the two crepe ratios can be varied relative to each other to control or vary sheet sidedness. Control systems can be used to monitor sheet properties and use these property measurements to control individual crepe ratios as well as differences between the two crepe ratios.

The paper web 102 is transferred from the second molding roll 1020 to the drying section 440, 540 in transfer nip 1050. As shown in FIG. 10A, the drying section 440 includes a Yankee dryer section 140, and the same considerations that apply to the transfer nip 450 of the first embodiment apply (see FIG. 4) to the transfer nip 1050 of this embodiment. As shown in FIG. 10B, a TAD drying section 540 is used, and the same considerations that apply to the transfer nip 550 (see FIG. 5) of the second embodiment apply to the transfer nip 1050 of this embodiment.

VIII. Eighth Embodiment of a Papermaking Machine

Figure 11A:
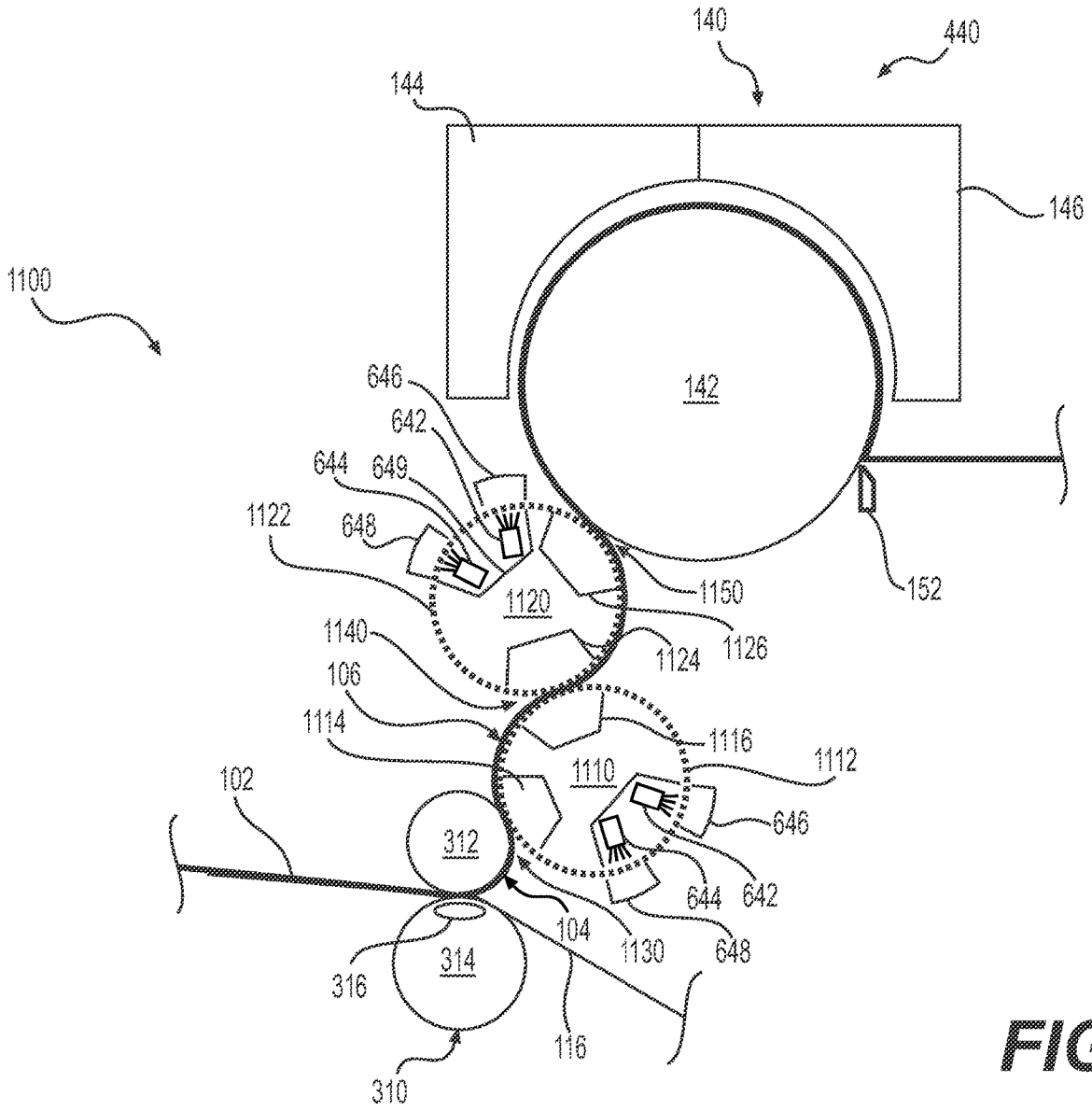
FIGS. 11A and 11B are schematic diagrams of a portion of a papermaking machine configuration of an eighth preferred embodiment of my invention.
Figure 11B:
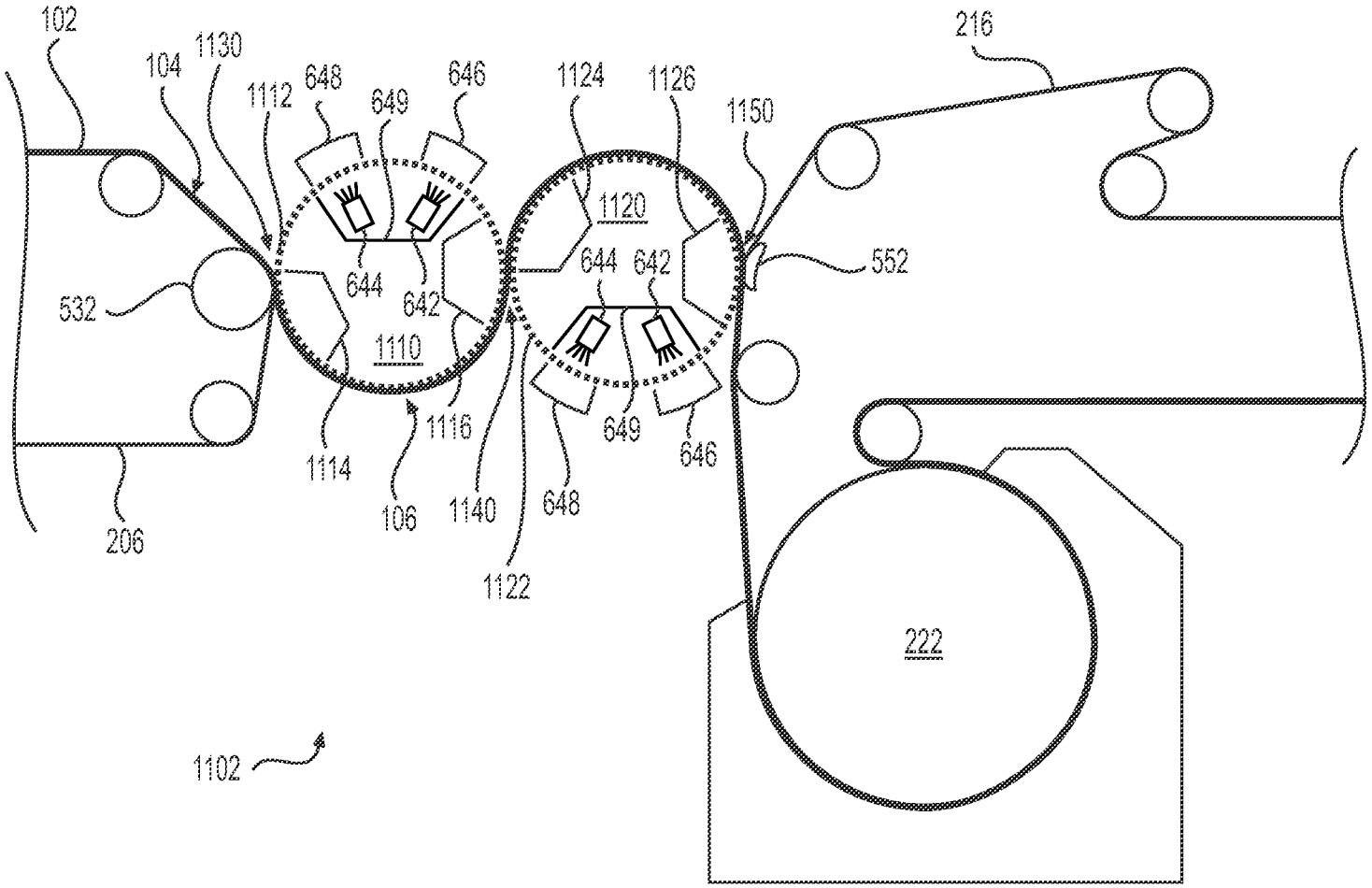

FIGS. 11A and 11B show an eighth embodiment of my invention. The papermaking machines 1100, 1102 of the eighth embodiment are similar to the papermaking machines 1000, 1002 of the seventh embodiment, but the two molding rolls 1110, 1120 of the eighth embodiment are constructed similarly to the molding roll 610 of the third embodiment (see FIGS. 6A and 6B) instead of the molding rolls 420, 520 of the first and second embodiments. The first molding roll 1110 has a permeable patterned surface 1112 and a vacuum box 1114. The moist nascent web 102 is transferred from the backing roll 312 or second forming fabric 206 in a first molding zone, which is a first molding nip 1130 in this embodiment, using any combination of vacuum transfer using the vacuum box 1114 of the first molding roll 1110, rush transfer (see Equation (4)) or a doctor blade 810 (see FIG. 8). The first molding nip 1130 may be operated similarly to the molding nip 620 of the third embodiment.

After the first side 104 of the paper web 102 is molded on the first molding roll 1110, the paper web is transferred from the first molding roll 1110 to the second molding roll 1120 in a second molding zone, which is a second molding nip 1140 in this embodiment, using any combination of a vacuum transfer using vacuum box 1124 of the second molding roll 1120, pressure differential using blow box 1116 of the first molding roll 1110, rush transfer (see Equation (5)). The second side 106 of the paper web 102 is then molded on the permeable patterned surface 1122 of the second molding roll 1120. The types of transfers used individually or in combination can be varied to control sheet properties and sheet sidedness. The considerations and parameters that apply to the blow box 616 and vacuum box 614 in the third embodiment also apply to the blow box 1116 of the first molding roll 1110 and the vacuum box 1124 of the second molding roll 1120.

The paper web 102 is transferred from the second molding roll 1120 to the drying section 440, 540 in transfer nip 1150. As shown in FIG. 11A, the drying section 440 includes a Yankee dryer section 140. As shown in FIG. 11B, a TAD drying section 540 is used. The same considerations that apply to the features of the transfer nip 630 in the third embodiment apply to the transfer nip 1150 of this embodiment, including the use of a blow box 1126 (similar to blow box 616) in the second molding roll 1120.

IX. Adjustment of Process Parameters to Control Fibrous Sheet Properties

Various properties of the resultant fibrous sheet (also referred to herein as paper properties or web properties) can be measured by techniques known in the art. Some properties may be measured in real time, while the paper web 102 is being processed. For example, moisture content and basis weight of the paper web 102 may be measured by a web property scanner positioned after the Yankee drum 142 and before the parent roll 190. Any suitable web property scanner known in the art may be used, such as an MXPro-Line scanner manufactured by Honeywell of Morristown, N.J., that is used to measure the moisture content with beta radiation and basis weight with gamma radiation. Other properties, for example, tensile strength (both wet and dry), caliper, and roughness, are more suitably measured offline. Such offline measurements can be conducted by taking a sample of the paper web 102 as it is produced on the paper machine and measuring the property in parallel with production or by taking a sample from the parent roll 190 and measuring the property after the parent roll 190 has been removed from the paper machine.

As discussed above in the first through the eighth embodiments, various process parameters can be adjusted to have an impact on the resulting fibrous sheet. These process parameters include, for example: the consistency of the moist nascent web 102 at the molding nips 430, 530, 620, 710, 1030, 1040, 1130, 1140 or molding zone 820; creping ratios; the load at the molding nips 430, 530, 620, 710, 1030, 1040, 1130, 1140; the vacuum drawn by vacuum boxes 614, 720, 1114, 1124; and the air pressure generated by blow boxes 616, 1116, 1126. Typically, a measured value for each paper property of the resultant fibrous sheet lies within a desired range for that paper property. The desired range will vary depending upon the end product of the paper web 102. If a measured value for a paper property falls outside the desired range, an operator can adjust the various process parameters of this invention so that, in a subsequent measurement of the paper property, the measured value is within the desired range.

The vacuum drawn by vacuum boxes 614, 720, 1114, 1124 and the air pressure generated by blow boxes 616, 1116, 1126 are process parameters that can be readily and easily adjusted while the paper machine is in operation. As a result, the papermaking processes of my invention, in particular those described in embodiments three through six and eight, may be advantageously used to make consistent fibrous sheet products by real time or near real time adjustment to the papermaking process.

X. Construction of the Permeable Molding Roll

Figure 12:
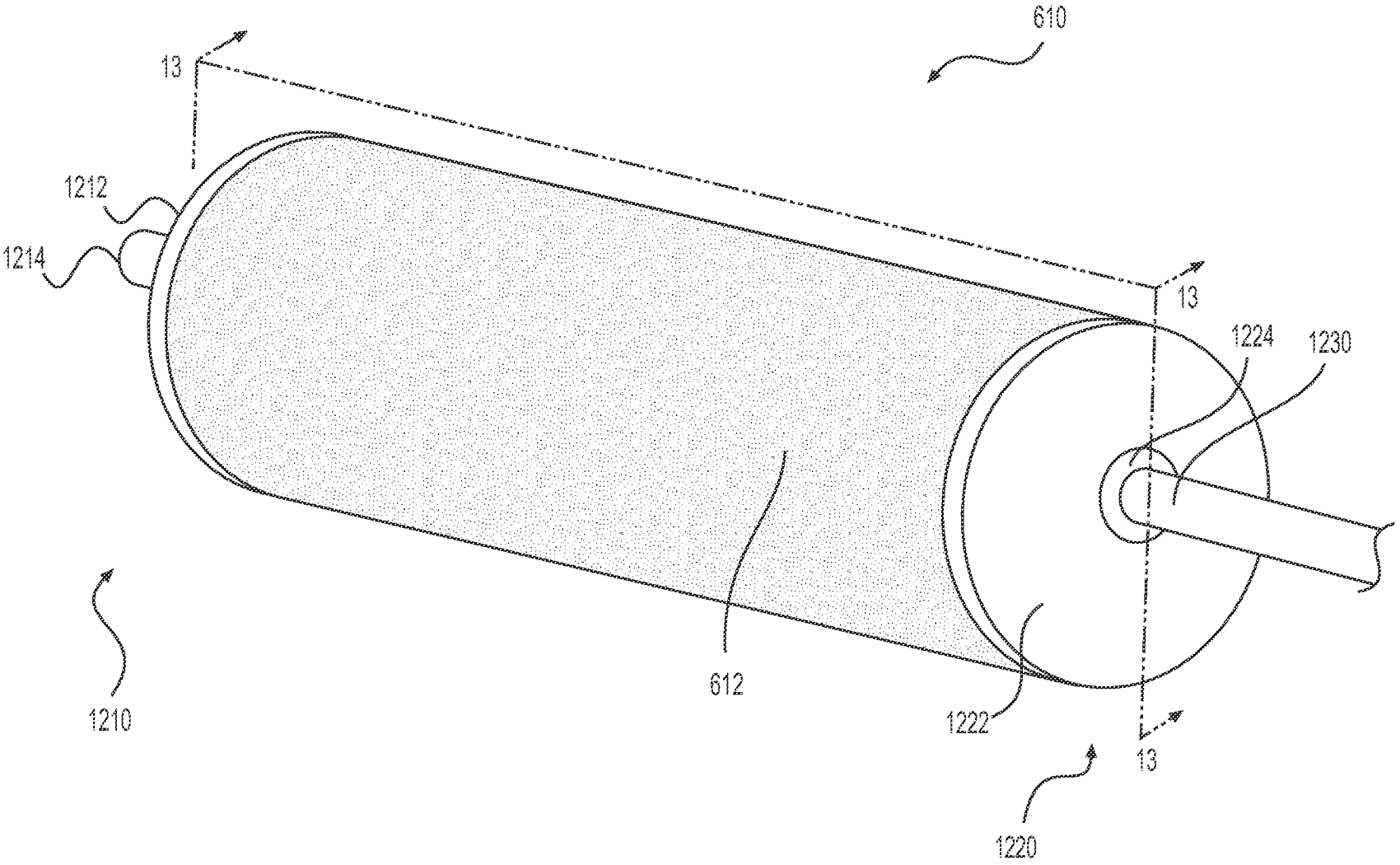
FIG. 12 is a perspective view of a molding roll of a preferred embodiment of my invention.
Figure 13:
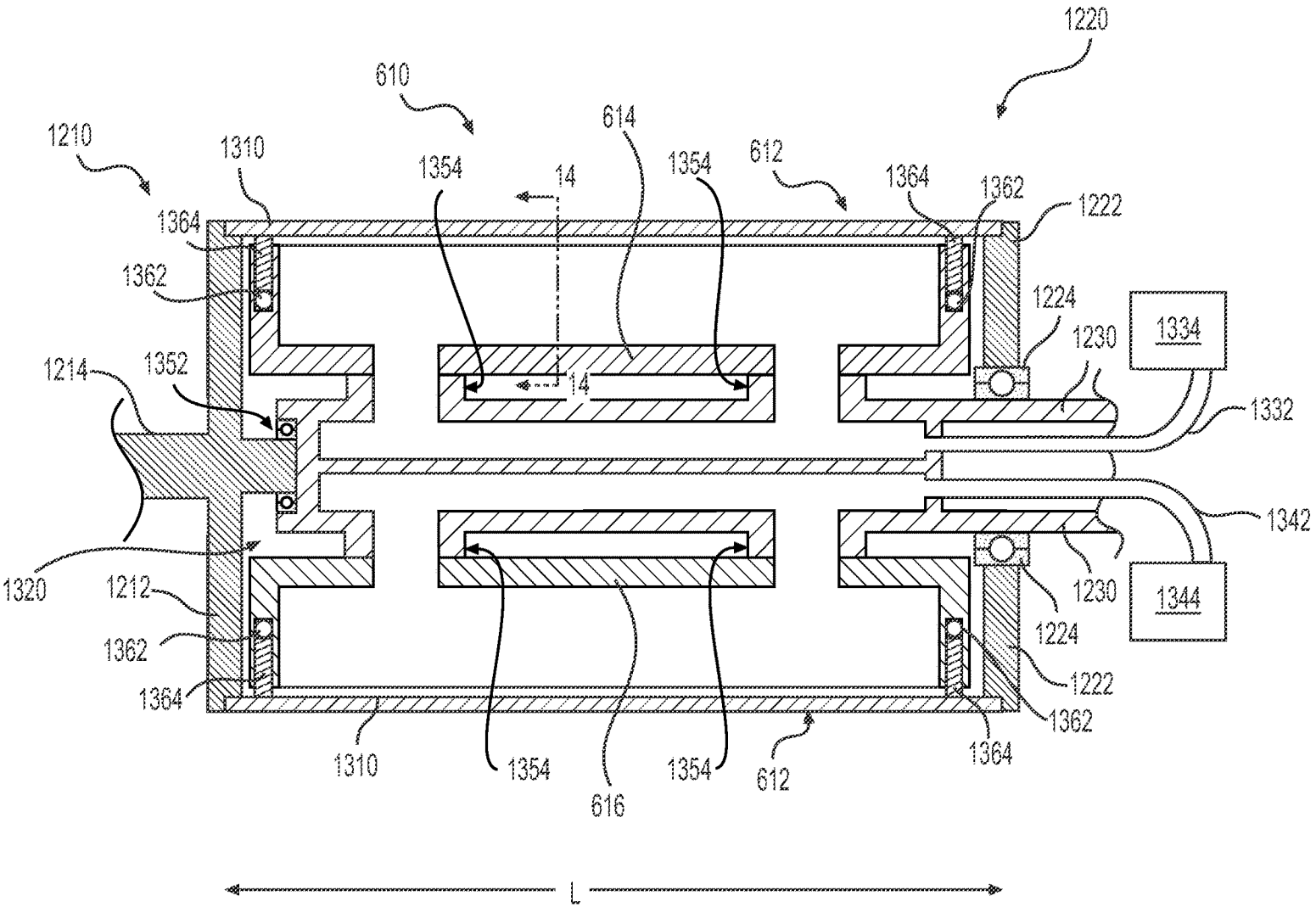
FIG. 13 is a cross-sectional view of the molding roll shown in FIG. 12 taken along the plane 13-13 of FIG. 12.

I will now describe the construction of the permeable molding roll 610, 920, 1110, 1120 used with the papermaking machines of the third through sixth and eighth embodiments. For simplicity, the reference numerals used to describe the molding roll 610 (FIGS. 6A and 6B) of the third embodiment above will be used to describe corresponding features below. FIG. 12 is a perspective view of the molding roll 610, and FIG. 13 is a cross-sectional view of the molding roll 610 shown in FIG. 12 taken along the plane 13-13. The molding roll 610 has a radial direction and a cylindrical shape with a circumferential direction C (see FIG. 14) that corresponds to the MD direction of the papermaking machine 600. The molding roll 610 also has a length direction L (see FIG. 13) that corresponds to the CD direction of the papermaking machine 600. The molding roll 610 may be driven on one end, the driven end 1210. Any suitable method known in the art may be used to drive the driven end 1210 of the molding roll 610. The other end of the molding roll 610, the rotary end 1220, is supported by and rotates about a shaft 1230. The driven end 1210 includes a driven endplate 1212 and a shaft 1214, which may be driven. The rotary end 1220 includes a rotary endplate 1222. In this embodiment, the driven endplate 1212 and the rotary endplate 1222 are constructed from steel, which is a relatively inexpensive structural material. Although, those skilled in the art will recognize that the endplates 1212, 1222 may be constructed from any suitable structural material. The rotary plate 1222 is attached to the shaft 1230 by a bearing 1224. A permeable shell 1310 is attached to the circumference of each of the driven endplate 1212 and the rotary endplate 1222 forming a void 1320 there between. The permeable patterned surface 612 is formed on the exterior of the permeable shell 1310. The details of the permeable shell 1310 will be discussed further below.

The vacuum box 614 and the blow box 616 are located in the void 1320 and are supported by shaft 1230 and a rotary connection 1352 to driven endplate 1212 through support structure 1354. Support structure 1354 allows both vacuum and pressurized air to be conveyed to vacuum box 614 and blow box 616, respectively, through the shaft 1230. Both the vacuum box 614 and the blow box 616 are stationary, and the permeable shell 1310 rotates around the stationary boxes 614, 616. Although FIG. 13 shows these boxes to be opposite to each other on the roll, it is recognized that they can be disposed at any angle around the roll circumference as needed to carry out their functions. Vacuum is drawn in vacuum box 614 through the use of a vacuum line 1332 that is part of the box support structure 1354. A vacuum pump 1334 thus is able to apply a vacuum to the vacuum box 614 via vacuum line 1332. Similarly, a pump or blower 1344 is used to force air through pressure line 1342 to create a positive pressure in blow box 616.

Figure 14:
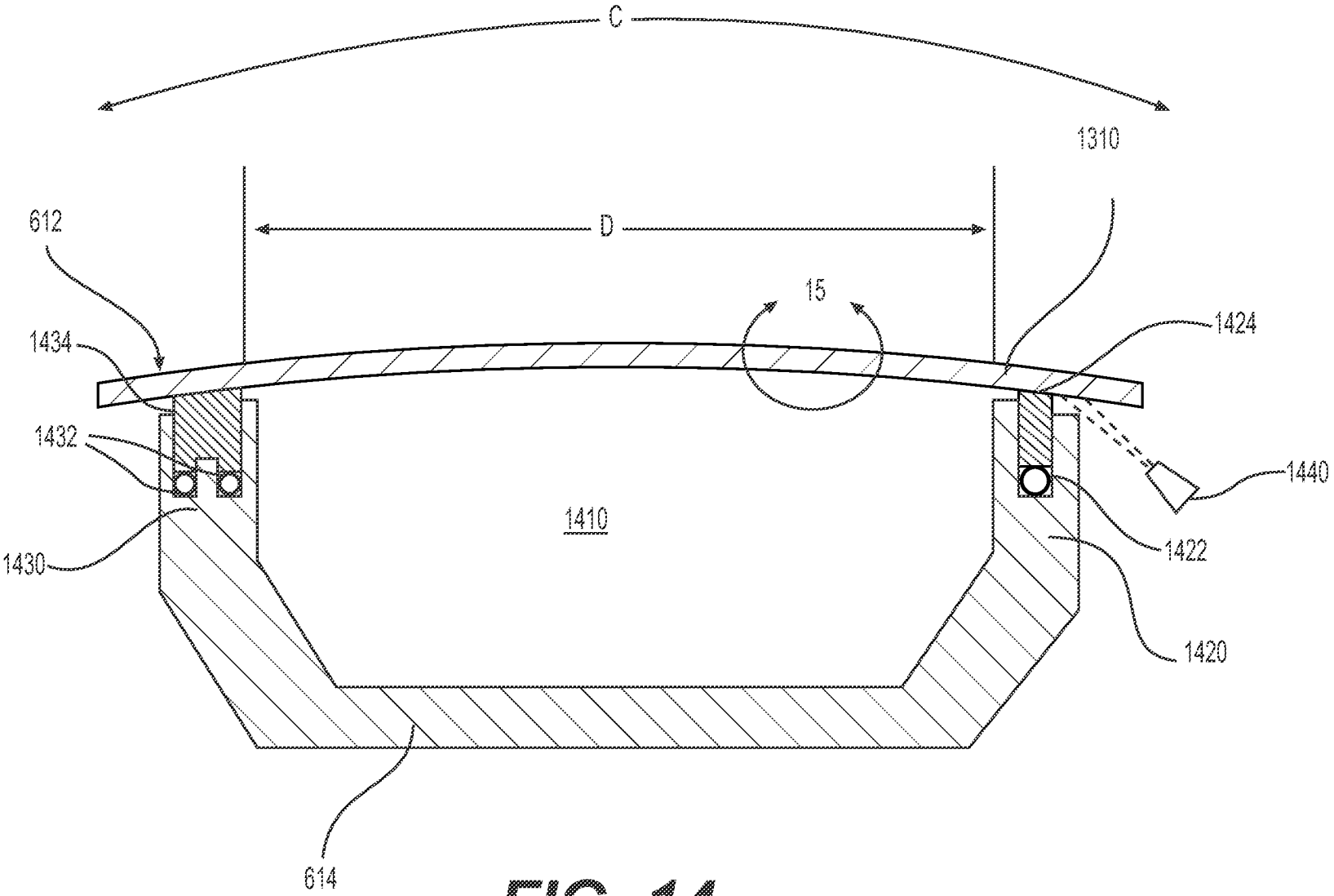
FIG. 14 is a cross-sectional view of the molding roll shown in FIG. 13 taken along line 14-14.

FIG. 14 shows cross section of the permeable shell 1310 and vacuum box 614, taken along line 14-14 in FIG. 13. The blow box 616 is constructed in substantially the same way as is the vacuum box 614. As shown in FIG. 14, the vacuum box 614 is substantially u-shaped having a first top ends 1420 and a second top end 1430. An open portion extends between the two top ends 1420, 1430 having a distance D in the circumferential (MD) direction C of the molding roll 610. The distance D of the open portion forms the vacuum zones discussed above. In this embodiment, the vacuum box 614 is constructed from stainless steel with walls that are thick enough to accommodate the vacuum generated in the cavity 1410 and to withstand the rigors of roll operation. Those skilled in the art will recognize that any suitable structural material can be used for the vacuum box but, preferably, is one that is resistant to corrosion from moisture that may be drawn from the web by the vacuum. In this embodiment, the vacuum box 614 is depicted with one single cavity 1410 extending in the length (CD) direction L of the molding roll 610. To draw a uniform vacuum across in the length (CD) direction L, it may be desirable to subdivide the vacuum box 614 into multiple cavities 1410. Those skilled in the art will recognize that any number of cavities may be used. Likewise, it may be desirable to subdivide the vacuum box 614 into multiple cavities in the circumferential (MD) direction C to form, for example, the two stage vacuum box discussed above.

A seal is formed between each end 1420, 1430 of the vacuum box 614 and an inside surface of the permeable shell 1310. In this embodiment, a tube 1422 is positioned in a cavity formed in the first top end 1420 of the vacuum box 614. Pressure is applied to inflate the tube 1422 and to press a sealing block 1424 against the inside surface of the permeable shell 1310. Likewise, two tubes 1432 are positioned inside cavities formed in the second top end 1430 and used to press a sealing block 1434 against the inside surface of the permeable shell 1310. In addition, an internal roll shower 1440 may be positioned upstream of the vacuum box to apply a lubricating material, such as water, to the bottom surface of the permeable shell 1310, thereby reducing frictional forces and wear between the sealing blocks 1424, 1434 and the permeable shell 1310. Similarly, each end in the CD direction of the vacuum box 614 and blow box 616 are sealed. As may be seen in FIG. 13, a tube 1362 is positioned in a cavity formed in the ends of the vacuum box 614 and blow box 616 and inflated to press a sealing block 1364 against the inside surface of the permeable shell 1310. Any suitable wear material, such as polypropylene or a polytetrafluoroethylene impregnated polymer, may be used as the sealing blocks 1364, 1424, and 1434. Any suitable inflatable material, such a rubber, may be used for the tubes 1362, 1422, 1432.

Figure 15A:
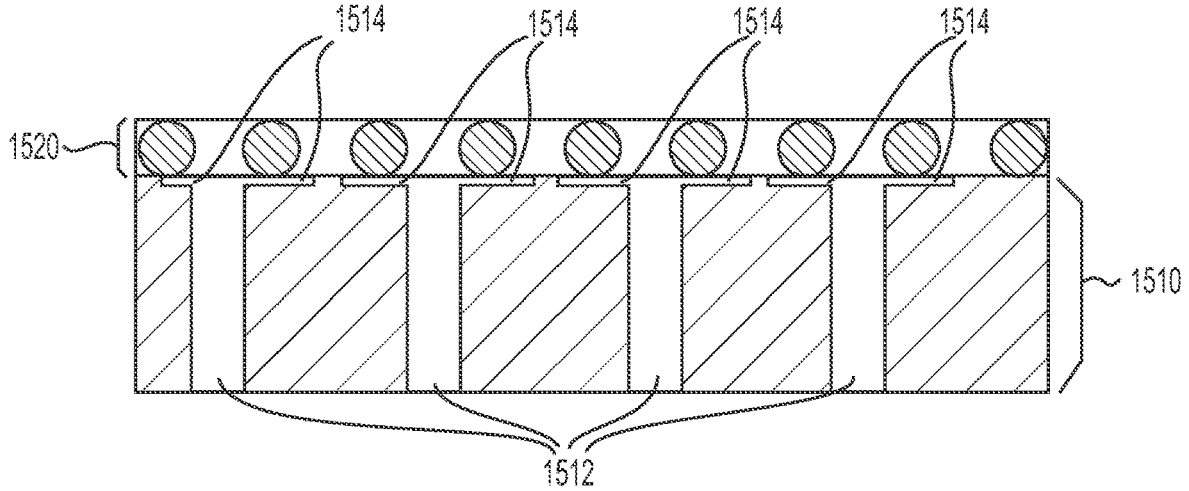
FIGS. 15A, 15B, 15C, 15D, and 15E are embodiments of a permeable shell showing detail 15 from FIG. 14.
Figure 15B:
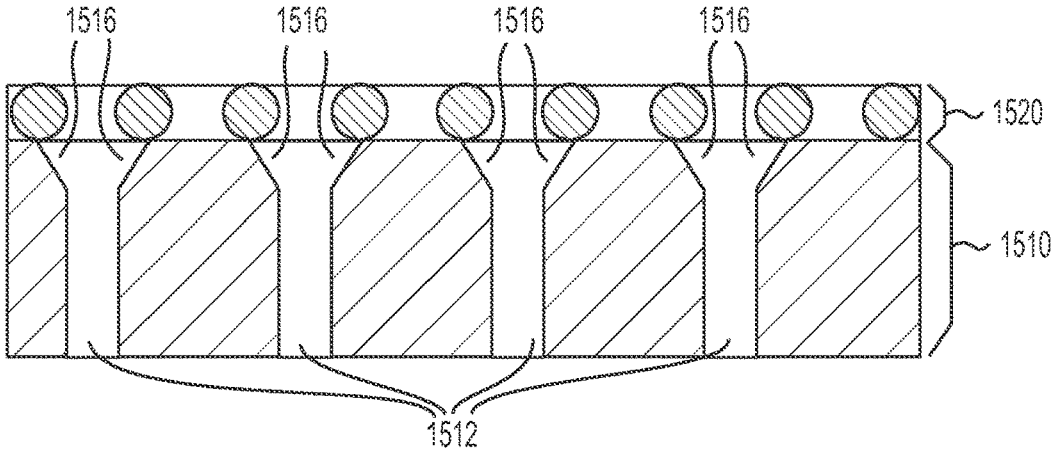
Figure 15C:
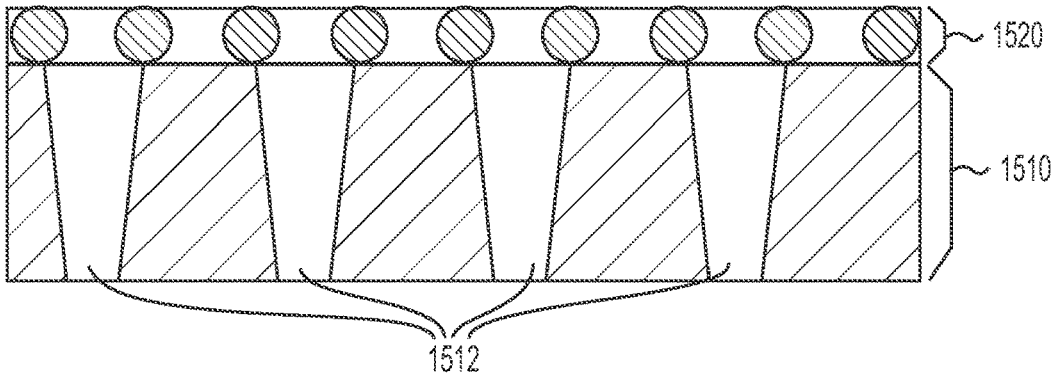

FIGS. 15A through 15E are embodiments of the permeable shell 1310 showing detail 15 in FIG. 14. FIGS. 15A, 15B, and 15C show a two layer construction of the permeable shell 1310. The inner most layer is structural layer 1510, and the outer layer is a molding layer 1520.

The structural layer 1510 provides the permeable shell 1310 support. In this embodiment, the structural layer 1510 is made from stainless steel, but any suitable structural material may be used. The thickness of the shell is designed to withstand the forces exerted during paper production, including, for example, the forces exerted when the molding nip 620 in the third embodiment is a pressure nip. The thickness of the structural layer 1510 is designed to withstand the loads on the roll to avoid fatigue and other failure. For example, the thickness will depend on the length of the roll, the diameter of the roll, the materials used, the density of channels 1512, and the loads applied. Finite element analysis can be used to determine practical roll design parameters and roll crown, if needed. The structural layer 1510 has a plurality of channels 1512. The plurality of channels 1512 connects the outer layer of the permeable shell 1310 with the inside of the molding roll 610. When a vacuum is drawn or a pressure is exerted from either of the vacuum box 614 or blow box 616, respectively, the air is pulled or pushed through the plurality of channels 1512.

The molding layer 1520 is patterned to redistribute and to orient the fibers of the web 102 as discussed above. In the third embodiment, for example, the molding layer 1520 is the permeable patterned surface 612 of the molding roll 610. As discussed above, my invention is particularly suited for producing absorbent paper products, such as tissue and towel products. Thus, to enhance the benefits in bulk and absorbency, the molding layer 1520 is preferably patterned on a fine scale suitable to orient fibers of the web 102. The density of each of the pockets and projections of the molding layer 1520 is preferably greater than about fifty per square inch and more preferably greater than about two hundred per square inch.

Figure 16:
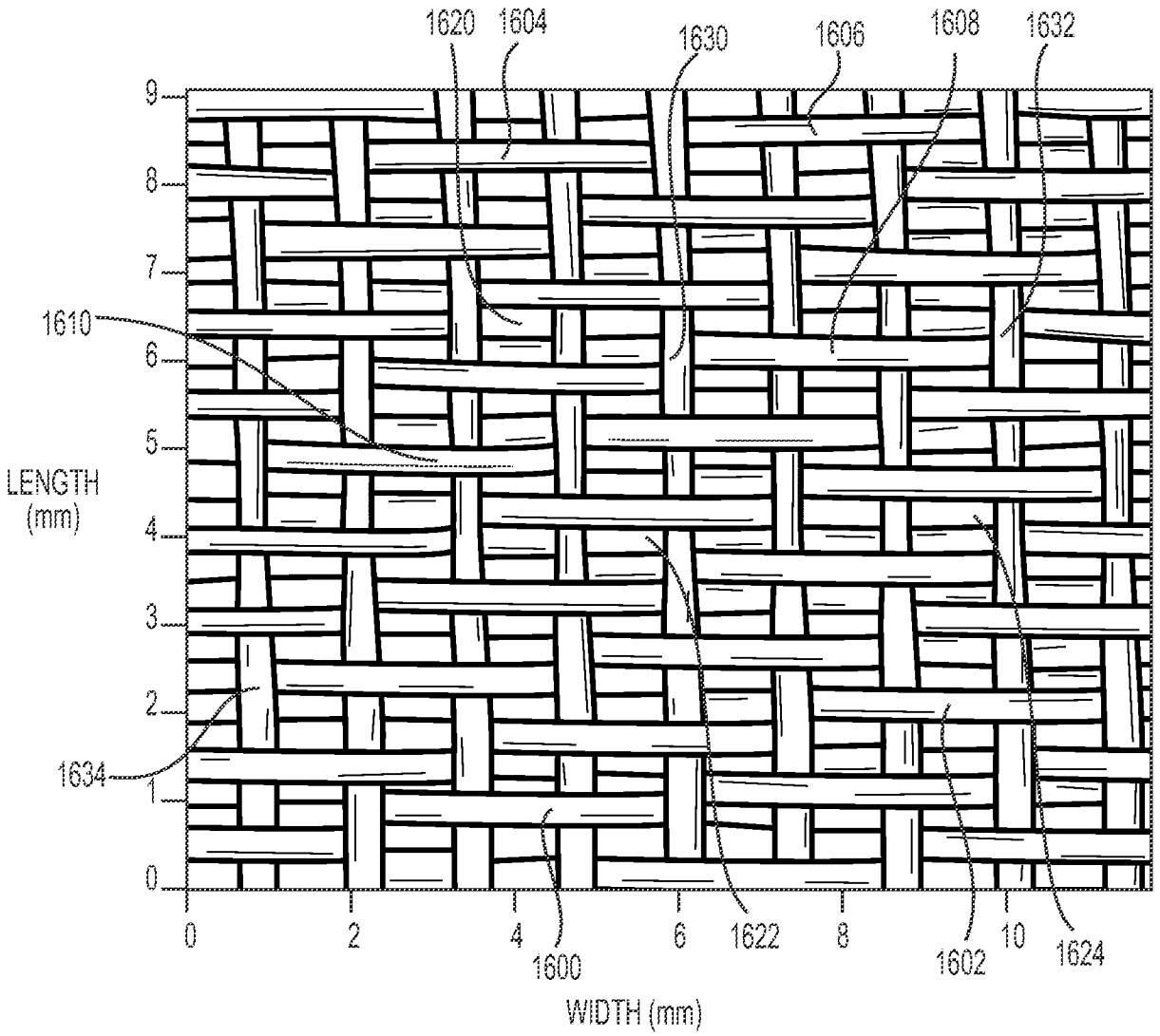
FIG. 16 is an example of a molding layer of a preferred embodiment of my invention.

FIG. 16 is an example of a preferred plastic, woven fabric that may be used as the molding layer 1520. In this embodiment, the woven fabric is shrunk around the structural layer 1510. The fabric is mounted in the apparatus as the molding layer 1520 such that its MD knuckles 1600, 1602, 1604, 1606, 1608, 1610 and so forth extend along the machine direction of the papermaking machine (e.g., 600 in FIG. 6A). The fabric may be a multi-layer fabric having creping pockets 1620, 1622, 1624, and so forth, between the MD knuckles of the fabric. A plurality of CD knuckles 1630, 1632, 1634, and so forth, is also provided, which may be preferably recessed slightly with respect to the MD knuckles 1600, 1602, 1604, 1606, 1608, 1610 of the creping fabric. The CD knuckles 1630, 1632, 1634 may be recessed with respect to the MD knuckles 1600, 1602, 1604, 1606, 1608, 1610 a distance of from about 0.1 mm to about 0.3 mm. This geometry creates a unique distribution of fiber when the web 102 is wet molded from the backing roll 312 or transfer fabric 512, as discussed above. Without intending to be bound by theory, it is believed that the structure illustrated, with relatively large recessed "pockets" and limited knuckle length and height in the CD, redistributes the fiber upon high impact creping to produce a sheet, which is especially suitable for recycle furnish and provides surprising caliper. In the sixth embodiment, the molding layer 1520 is not attached to the structural layer 1510 and is the molding fabric 910 shown in FIGS. 9A and 9B.

The molding layer 1520 is not limited, however, to woven structures. For example, the molding layer 1520 may be a layer of plastic or metal that has been patterned by knurling, laser drilling, etching, machining, embossing, and the like. The layer of plastic or metal may be suitably patterned either before or after it is applied to the structural layer 1510 of molding roll 610.

Referring back to FIG. 15A, the spacing and diameter of the plurality of channels 1512 are preferably designed to provide a relatively uniform vacuum or air pressure at the roll surface of the molding layer 1520. To aid in applying uniform pressure, grooves 1514 that extend or radiate from the plurality of channels 1512 may be cut in the outer surface of the structural layer 1510. Although, other suitable channel designs may be used to assist in spreading the suction or air pressure under the molding layer 1520. For example, the top edge of the each channel 1512 may have a chamfer 1516, as shown in FIG. 15B. In addition, the channel 1512 geometry is not limited to right, circular cylinders. Instead, other suitable geometries may be used including, for example, a right, trapezoidal cylinder, as shown in FIG. 15C, which may be formed when the plurality of channels 1512 is created by laser drilling.

The plurality of channels 1512 preferably have a construction consistent with the structural needs of the permeable shell 1310 and the ability to uniformly apply vacuum or pressure to the molding surface to effect sheet transfer and molding. In the embodiments shown in FIGS. 15A, 15B, and 15C, the plurality of channels 1512 preferably has a mean diameter from about two hundredths of an inch to about a half of an inch, more preferably from about sixty-two thousandths of an inch to about a quarter of an inch. In calculating the mean diameter, the diameter of the grooves 1514 and chamfer 1516 may be excluded. Each channel 1512 is preferably spaced from about sixty-four thousandths of an inch to about three hundred seventy-five thousandths of an inch from the next closest channel 1512, more preferably from about one hundred twenty-five thousandths of an inch to about a quarter of an inch. Additionally, the structural layer 1510 preferably has a density of between about fifty channels per square inch to about five hundred channels per square inch. The closer spaced channels and higher channel densities may achieve a better, more uniform distribution of air.

Figure 15D:
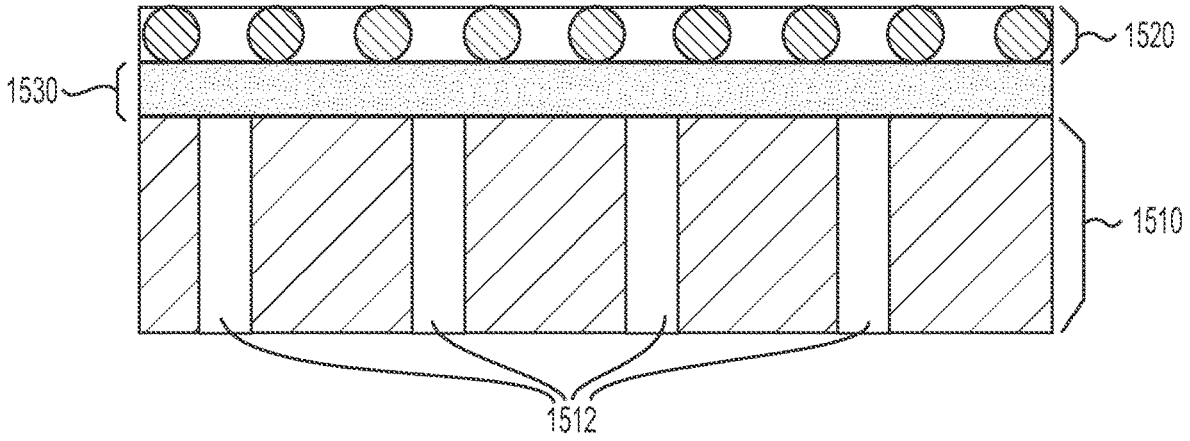

It may be difficult, however, to achieve a sufficient density of the plurality of channels 1512 to apply uniform air pressure to the molding layer 1520 and still have the structural layer provide sufficient structural support with the embodiment shown in FIG. 15A. To alleviate this concern, an air distribution layer 1530 may be used as a middle layer, as shown in FIG. 15D. The air distribution layer 1530 is preferably formed by a permeable material that allows the air pushed or drawn through the plurality of channels 1512 to spread under the molding layer 1520, thus creating a generally uniform draw or pressure. Any suitable material may be used including, for example, porous sintered metals, sintered polymers, and polymer foams. Preferably, the thickness of the air distribution layer 1530 is from about one tenth of an inch to about one inch, more preferably about an eighth of an inch to about a half of an inch. When the air distribution layer 1530 is used, the density of the plurality of channels 1512 may be spread out and the diameters increased. In the embodiment shown in FIG. 15D, the plurality of channels 1512 preferably has a diameter from about two hundredths of an inch to about five tenths of an inch, more preferably from about five hundredths of an inch to about a quarter of an inch. Each channel 1512 is preferably spaced from about five hundredths of an inch to about one inch from the next closet channel 1512, more preferably from about on tenth of an inch to about five tenths of an inch. Additionally, the structural layer 1510 preferably has a density of between about fifty channels 1512 per square inch to about three hundred channels 1512 per square inch.

Figure 15E:
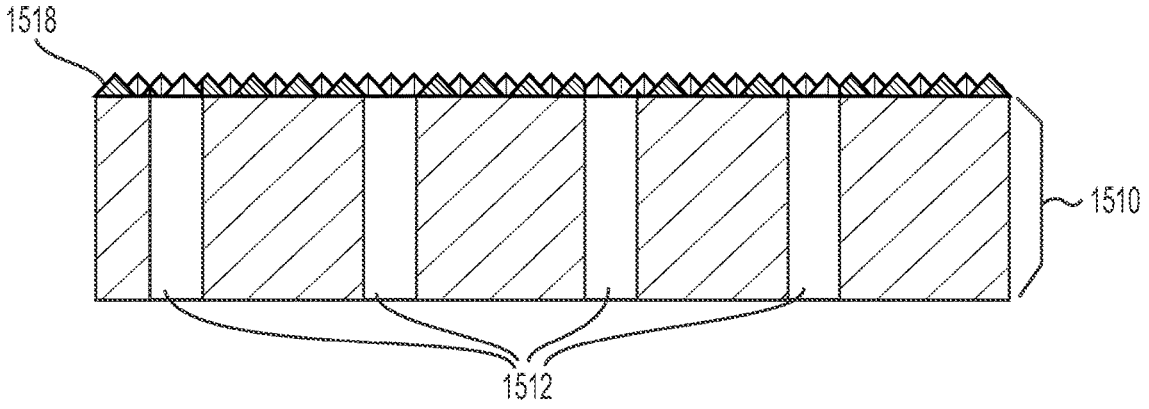

As shown in FIG. 15E, a separate molding layer 1520 may not be necessary. Instead, the outer surface 1518 of the structural layer 1510 may be textured or patterned to form the permeable patterned surface 612. In the embodiment shown in FIG. 15E, the outer surface 1518 is patterned by knurling, but any suitable method known in the art, including, for example, laser drilling, etching, embossing, or machining, may be used to texture or to pattern the outer surface 1518. Although 15E shows patterning on top of a drilled shell it is also possible to apply patterning by knurling, laser drilling, etching, embossing, or machining the outer surface of the air distribution layer 1530 or molding layer 1520, as discussed above.

Figure 17:
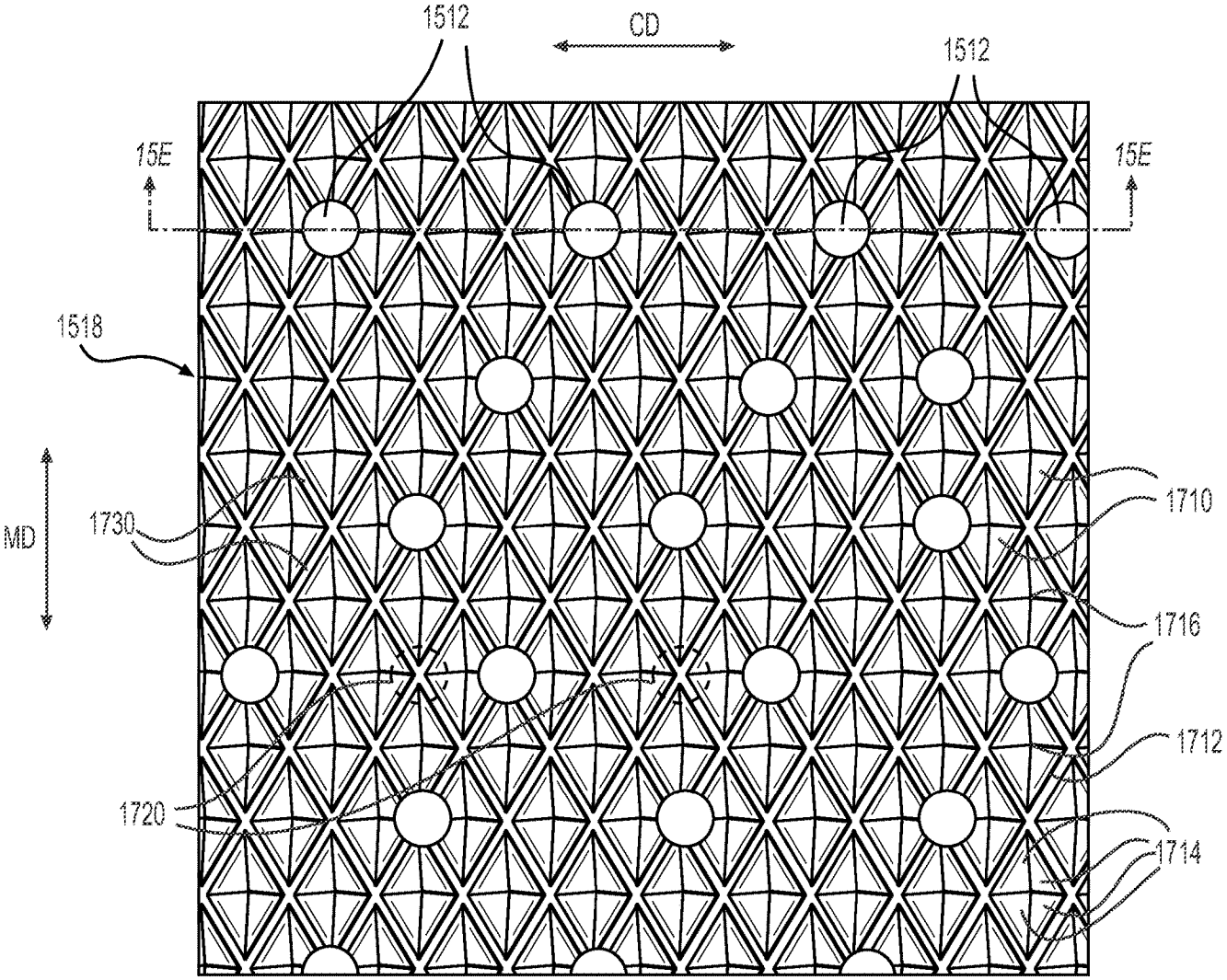
FIG. 17 is an example of a molding layer of a preferred embodiment of my invention.

FIG. 17 shows a top view of a knurled outer surface 1518, and the section shown in FIG. 15E is taken along line 15E-15E shown in FIG. 17. While any suitable pattern may be used, the knurled surface has a plurality projections 1710, which in this embodiment, are pyramid shaped. The pyramid-shaped projections 1710 of this embodiment have a major axis extending in the MD direction of the molding roll 610 and a minor axis extending in the CD direction of the molding roll 610. The major axis is longer than the minor axis, giving the base 1712 of the pyramid-shaped projections 1710 a diamond shape. The pyramid-shaped projections 1710 have four lateral sides 1714 that angle and extend downward from the pinnacle 1716 to the base 1712. Thus, the area where four vertices of four different pyramid-shaped projections 1710 come together forms a recess or pocket 1720. The pyramid-shaped projections 1710 and pockets 1720 of the knurled outer surface 1518 redistribute the papermaking fibers to mold and to form inverse recesses and protrusions on the paper web 102.

The pyramid-shaped projections 1710 are separated by grooves 1730. The grooves 1730 of the knurled outer surface 1518 are similar to the grooves 1514 described above with reference to FIG. 15A. The grooves 1730 radiate outward from a channel 1512 to distribute the air being pushed or pulled through the channels 1512 across the knurled outer surface 1518 and help to evenly distribute the air across the knurled outer surface 1518.

XI. Construction of the Non-Permeable Molding Roll

Figure 18:
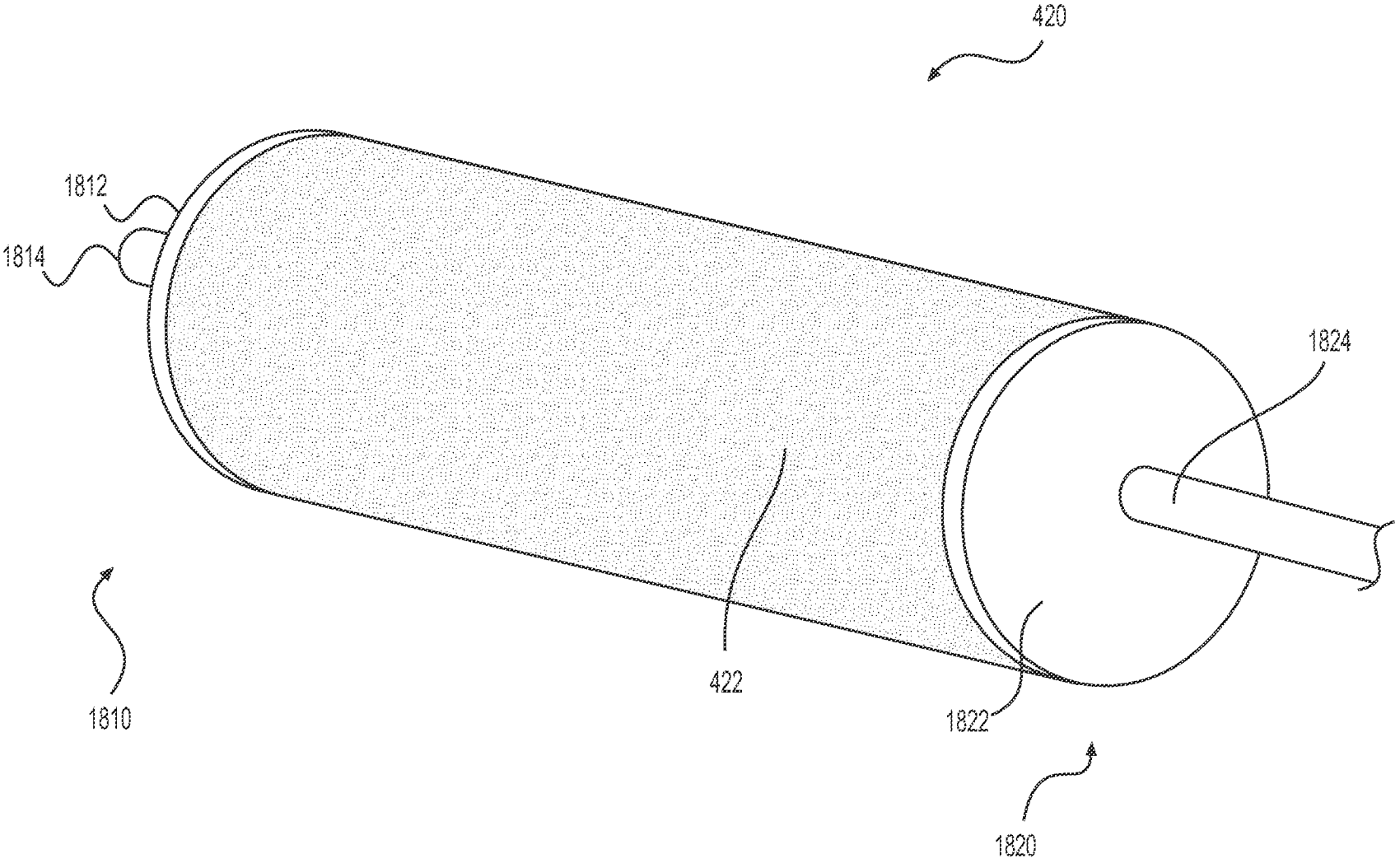
FIG. 18 is a perspective view of a molding roll of a preferred embodiment of my invention.

I will now describe the construction of the non-permeable molding roll 420, 520, 1010, 1020 used with the papermaking machines of the first, second, and seventh embodiments. For simplicity, the reference numerals used to describe the molding roll 420 of the first embodiment above will be used to describe corresponding features below. FIG. 18 is a perspective view of the non-permeable molding roll 420. As with the permeable molding roll 610, described above, the non-permeable molding roll 420 has a radial direction and a cylindrical shape with a circumferential direction that corresponds to the MD direction of the papermaking machine 400. The molding roll 420 also has a length direction that corresponds to the CD direction of the papermaking machine 400.

The non-permeable molding roll 420 has a first end 1810 and a second end 1820. Either one or both of the first or second ends 1810, 1820 may be driven by any suitable means known in the art. In this embodiment, both ends have shafts 1814, 1824 that are, respectively, connected to end-plates 1812, 1822. The end plates 1812, 1822 support each end of a shell (not shown) on which the patterned surface 422 is formed. The roll may be made from any suitable structural material known in the art including, for example, steel. The shell forms the structural support for the patterned surface 422 and may be constructed as a stainless steel cylinder, similar to the permeable shell 1310 discussed above but without the channels 1512. The molding roll 420, however, is not limited to this construction. Any suitable roll construction known in the art may be used to construct the non-permeable molding roll 420.

The patterned surface 422 may be formed similarly to the molding layer 1520 discussed above. For example, the patterned surface 422 may be formed by a woven fabric (such as the fabric discussed above with reference to FIG. 14) that is shrunk around the shell of the non-permeable molding roll. In another example, the outer surface of the shell may be textured or patterned. Any suitable method known in the art, including, for example, knurling (such as the knurling discussed above with reference to FIG. 17), etching, embossing, or machining, may be used to texture or pattern the outer surface. The patterned surface 422 may also be formed by laser drilling or etching and, in such a case, is preferably formed from an elastomeric plastic, but any suitable material may be used.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive and the scope of the invention to be determined by any claims supportable by this application and the equivalents thereof, rather than by the foregoing description.

INDUSTRIAL APPLICABILITY

The invention can be used to produce desirable paper products, such as paper towels and bath tissue. Thus, the invention is applicable to the paper products industry.

I claim:

1. A roll for molding a fibrous sheet, the roll comprising:

(A) a cylindrical shell configured to be rotatably driven in a circumferential direction, the cylindrical shell including:

(a) an interior surface;

(b) an exterior surface, and surface;

(c) a permeable patterned surface on the exterior surface of the cylindrical shell, the permeable patterned surface having at least one of a plurality of recesses and a plurality of projections, the density of the at least one of the plurality of recesses and the plurality of projections being greater than about fifty per square inch;

(d) a plurality of holes extending from the exterior surface to the interior surface to allow air to be moved through the cylindrical shell, each hole of the plurality of holes having an exterior end and an interior end; and (e) a plurality of grooves, each groove of the plurality of grooves being fluidly connected to the exterior end of each hole of the plurality of holes and extending outward from the corresponding hole; and (B) a vacuum box positioned on the inside of the cylindrical shell and being configured to draw air from the exterior surface of the cylindrical shell to the interior surface of the cylindrical shell, the vacuum box being stationary with respect to the rotation of the cylindrical shell.

2. The roll of claim 1, further comprising (C) a vacuum pump being connected to the vacuum box, wherein the vacuum pump is used to draw air from the exterior surface of the cylindrical shell to the interior surface of the cylindrical shell.

3. The roll of claim 1, further comprising (C) a blow box positioned on the inside of the cylindrical shell and being configured to push air from the interior surface of the cylindrical shell to the exterior surface of the cylindrical shell, the blow box being stationary with respect to the rotation of the cylindrical shell.

4. The roll of claim 3, further comprising (D) a pump being connected to the blow box, wherein the pump is used to push air from the interior surface of the cylindrical shell to the exterior surface of the cylindrical shell.

5. The roll of claim 1, wherein the density of the at least one of the plurality of recesses and the plurality of projections is greater than about two hundred per square inch.

6. The roll of claim 1, wherein the permeable patterned surface is formed by at least one of knurling, laser drilling, etching, embossing, and machining the exterior surface of the cylindrical shell.

7. The roll of claim 1, wherein the cylindrical shell further includes (f) a structural layer, the plurality of holes extending through the thickness of the structural layer and being configured to allow air to be moved through the structural layer.

8. The roll of claim 7, wherein the permeable patterned surface is a molding layer formed on an exterior surface of the structural layer, the plurality of grooves extending underneath the molding layer.

9. The roll of claim 8, wherein the molding layer comprises a woven structure adapted for enhancing sheet properties.

10. The roll of claim 7, wherein the permeable patterned surface is a fabric supported by the structural layer, plurality of grooves extending underneath the fabric.

11. The roll of claim 1, further comprising (C) a cleaning section positioned on the inside of the cylindrical shell and being configured to direct a cleaning medium from the interior surface of the cylindrical shell to the exterior surface of the cylindrical shell.

12. The roll of claim 11, wherein the cleaning section includes a shower and the cleaning medium includes at least one of water and a cleaning solution.

13. The roll of claim 1, wherein the permeable patterned surface includes the plurality of projections, and wherein one projection of the plurality of projections is separated from another one of the plurality of projections by one of the plurality of grooves.

14. A roll for molding a fibrous sheet, the roll comprising:

(A) a cylindrical shell configured to be rotatably driven in a circumferential direction, the cylindrical shell including:

(a) an interior surface;

(b) an exterior surface;

(c) a permeable patterned surface on the exterior surface of the cylindrical shell, the permeable patterned surface having at least one of a plurality of recesses and a plurality of projections, the density of the at least one of the plurality of recesses and the plurality of projections being greater than about fifty per square inch; and (d) a plurality of holes extending from the exterior surface to the interior surface to allow air to be moved through the cylindrical shell, each hole of the plurality of holes having (i) an exterior end, (ii) a cross-sectional area at the exterior end, (iii) an interior end, and (iv) a cross-sectional area at the interior end, the cross-sectional area at the exterior end being larger than the cross-sectional area at the interior end; and (B) a vacuum box positioned on the inside of the cylindrical shell and being configured to draw air from the exterior surface of the cylindrical shell to the interior surface of the cylindrical shell, the vacuum box being stationary with respect to the rotation of the cylindrical shell.

15. The roll of claim 14, wherein each of the plurality of holes has a chamfer on the exterior end.

16. The roll of claim 14, wherein each of the plurality of holes is a right, trapezoidal cylinder.

17. The roll of claim 14, further comprising (C) a vacuum pump being connected to the vacuum box, wherein the vacuum pump is used to draw air from the exterior surface of the cylindrical shell to the interior surface of the cylindrical shell.

18. The roll of claim 14, further comprising (C) a blow box positioned on the inside of the cylindrical shell and being configured to push air from the interior surface of the cylindrical shell to the exterior surface of the cylindrical shell, the blow box being stationary with respect to the rotation of the cylindrical shell.

19. The roll of claim 18, further comprising (D) a pump being connected to the blow box, wherein the pump is used to push air from the interior surface of the cylindrical shell to the exterior surface of the cylindrical shell.

20. The roll of claim 14, wherein the density of the at least one of the plurality of recesses and the plurality of projections is greater than about two hundred per square inch.

21. The roll of claim 14, wherein the cylindrical shell further includes (e) a structural layer, the plurality of holes extending through the thickness of the structural layer and being configured to allow air to be moved through the structural layer.

22. The roll of claim 21, wherein the permeable patterned surface is a molding layer formed on an exterior surface of the structural layer.

23. The roll of claim 22, wherein the molding layer comprises a woven structure adapted for enhancing sheet properties.

24. The roll of claim 21, wherein the permeable patterned surface is a fabric supported by the structural layer.

25. The roll of claim 14, further comprising (C) a cleaning section positioned on the inside of the cylindrical shell and being configured to direct a cleaning medium from the interior surface of the cylindrical shell to the exterior surface of the cylindrical shell.

26. The roll of claim 25, wherein the cleaning section includes a shower and the cleaning medium includes at least one of water and a cleaning solution.

27. A roll for molding a fibrous sheet, the roll comprising:

(A) a cylindrical shell configured to be rotatably driven in a circumferential direction, the cylindrical shell including:

(a) a structural layer having an interior surface, an exterior surface, and a plurality of holes extending from the exterior surface to the interior surface to allow air to be moved through the structural layer;

(b) a molding layer having a permeable patterned surface, the permeable patterned surface having at least one of a plurality of recesses and a plurality of projections, the density of the at least one of the plurality of recesses and the plurality of projections being greater than about fifty per square inch; and (c) an air distribution layer located between the structural layer and the molding layer, the air distribution layer being permeable to distribute air moved through the structural layer in the circumferential direction of the shell and under the molding layer; and (B) a vacuum box positioned on the inside of the cylindrical shell and being configured to draw air through the molding layer, the air distribution layer, and the plurality of holes to the interior surface of the structural layer, the vacuum box being stationary with respect to the rotation of the cylindrical shell.

28. The roll of claim 27, wherein the molding layer comprises a woven structure adapted for enhancing sheet properties.

29. The roll of claim 27, wherein the air distribution layer comprises at least one of sintered metals, sintered polymers, and polymer foams.

30. The roll of claim 27, further comprising (C) a vacuum pump being connected to the vacuum box, wherein the vacuum pump is used to draw air through the molding layer, the air distribution layer, and the plurality of holes to the interior surface of the structural layer.

31. The roll of claim 27, further comprising (C) a blow box positioned on the inside of the cylindrical shell and being configured to push air from the interior surface of the structural layer through the plurality of holes, the air distribution layer, and the molding layer, the blow box being stationary with respect to the rotation of the cylindrical shell.

32. The roll of claim 31, further comprising (D) a pump being connected to the blow box, wherein the pump is used to push air from the interior surface of the structural layer through the plurality of holes, the air distribution layer, and the molding layer.

33. The roll of claim 27, wherein the density of the at least one of the plurality of recesses and the plurality of projections is greater than about two hundred per square inch.

* * * * *